US005711661A

United States Patent [19]

Kushch et al.

[11] Patent Number: 5,711,661

[45] Date of Patent: Jan. 27, 1998

[54] HIGH INTENSITY, LOW $NO_x$ MATRIX BURNER

[75] Inventors: Aleksandr S. Kushch, La Mesa; Mark K. Goldstein, Del Mar, both of Calif.

[73] Assignee: Quantum Group, Inc., San Diego, Calif.

[21] Appl. No.: 237,306

[22] Filed: May 3, 1994

[51] Int. Cl.[6] ..... F23D 13/12

[52] U.S. Cl. ..... 431/329; 431/326; 431/7

[58] Field of Search ..... 431/7, 170, 326, 431/328, 329

[56] References Cited

U.S. PATENT DOCUMENTS

| | | | |
|---|---|---|---|
| 3,179,156 | 4/1965 | Weiss et al. | 158/116 |
| 3,331,707 | 7/1967 | Werth | 136/89 |
| 3,383,159 | 5/1968 | Smith, Jr. | 431/7 |
| 3,751,213 | 8/1973 | Sowards | 431/328 |
| 3,765,820 | 10/1973 | Ito et al. | 431/75 |
| 4,154,568 | 5/1979 | Kendall et al. | 431/7 |
| 4,285,666 | 8/1981 | Burton et al. | 431/7 |
| 4,318,392 | 3/1982 | Schreiber et al. | 126/110 |
| 4,412,523 | 11/1983 | Schreiber et al. | 126/92 |
| 4,416,618 | 11/1983 | Smith | 431/328 |
| 4,492,185 | 1/1985 | Kendall et al. | 122/32 |
| 4,494,485 | 1/1985 | Kendall et al. | 122/250 |
| 4,597,734 | 7/1986 | McCausland et al. | 431/328 |
| 4,643,667 | 2/1987 | Fleming | 431/7 |
| 4,654,000 | 3/1987 | Smith | 431/328 |
| 4,664,620 | 5/1987 | Kendall et al. | 431/328 |
| 4,776,895 | 10/1988 | Goldstein | 136/253 |

(List continued on next page.)

FOREIGN PATENT DOCUMENTS

| | | | |
|---|---|---|---|
| 410569A1 | 1/1991 | European Pat. Off. . | |
| 1419698 | 10/1965 | France . | |
| 464692 | 8/1928 | Germany | 431/328 |
| 466586 | 9/1928 | Germany | 431/328 |
| 564387 | 6/1957 | Italy | 431/328 |
| 58-049804 | 3/1983 | Japan . | |
| 58-49804 | 3/1983 | Japan . | |
| 0153017 | 8/1984 | Japan | 431/328 |
| 60-223909 | 11/1985 | Japan . | |
| 907061 | 10/1961 | United Kingdom . | |

OTHER PUBLICATIONS

Color photocopy of photographs of product and photocopy of product information for "American Camper" Propane Portable Infra Red Camp Heater available from Nelson/Weather–Rite Inc. of Secaucus, NJ or Lenexa, KS. (no date).

Kawaguchi et al., "Premixed Combustion at a Fiber Mat," Twenty–Third Symposium (International) on Combustion/The Combustion Institute (1990), pp. 1019–1024.

(List continued on next page.)

*Primary Examiner*—Carl D. Price

*Attorney, Agent, or Firm*—Christie, Parker & Hale, LLP

[57] ABSTRACT

A multilayer matrix burner which has exceptionally low $NO_x$ emissions can be operated over a broad turndown range. The burner is, in effect, a three-dimensional matrix of spaced apart emissive layers. There is a first three-dimensional porous layer which acts to distribute a fuel/air mixture. There is a wider gap (which may be adjustable) between the distributive layer and one or more two-dimensional porous emissive layers. An exemplary emissive layer is a refractory wire screen. Preferably, there are multiple such emissive layers with a narrower gap between successive layers. Preferably, the porosity increases in each successive layer downstream from the preceding layer. This arrangement provides a stable flame wherein most of the combustion occurs adjacent to successive incandescent emissive layers. Preferably the successive layers in the downstream direction have a large open area for transmitting radiant energy from preceding emissive layers. Such high intensity burners, e.g. 1,500,000 BTU/h·ft$^2$, may be used in water heaters or boilers or in a thermophotovoltaic apparatus which produces both electric energy and heated water. For a thermophotovoltaic application, the matrix burner preferably has a smaller open area than upstream layers for providing a location of highest temperature on the outermost layer.

15 Claims, 15 Drawing Sheets

U.S. PATENT DOCUMENTS

| | | | |
|---|---|---|---|
| 4,782,814 | 11/1988 | Cherryholmes | 126/92 |
| 4,809,672 | 3/1989 | Kendall et al. | 126/91 |
| 5,137,583 | 8/1992 | Parent et al. | 136/253 |
| 5,211,552 | 5/1993 | Krill et al. | 431/7 |
| 5,240,411 | 8/1993 | Abalos | 431/329 |
| 5,281,131 | 1/1994 | Goldstein | 431/253 |
| 5,326,257 | 7/1994 | Taylor et al. | 431/329 |
| 5,326,631 | 7/1994 | Carswell et al. | 428/256 |
| 5,360,490 | 11/1994 | Nelson | 136/253 |
| 5,399,085 | 3/1995 | Taylor | 431/353 |

OTHER PUBLICATIONS

Williams et al., "The Formation of $NO_x$ in Surface Burners," Combustion and Flame 89 (1992), pp. 157–166.

Minden et al., "Premixed Radiant Burners: Improved Process Performance with Ultra-Low $NO_x$ Emissions," AFRC90–Paper #28, pp. 1–17 (no date).

Pam et al., "Burner Survey for a High Efficiency Gas–Fired Heating Unit," Alzeta Corporation, Mountain View, California, Prepared for Gas Research Institute, Chicago PB84–222819 (no date).

Alzeta Corporation, Santa Clara, California, Alzeta Radiant Burner Product Characteristics, Tomorrow's Clean Energy Solutions, Today! 1 page (no date).

Maxon Corporation, Muncie, Indiana, Design and Application Details, INFRAWAVE® Burners, 10 pages (no date).

PVI Industries, Fort Worth, Texas, TURBOPOWER® Boilers, 4 pages (no date).

Lochinvar Water Heater Corporation, Nashville, TN, Power–Fin Gas–Fired Boilers, 6 pages (no date).

Lochinvar Water Heater Corporation, Nashville, TN, Copper–Fin II Commercial Gas Water Heaters, 6 pages (no date).

"Advanced Low $NO_x$ Burner Systems," Alzeta Corporation, Santa Clara, California, 13 pages (no date).

HIGH INTENSITY, LOW $NO_X$ MATRIX BURNER

BACKGROUND

This invention relates to gaseous fuel combustion in a wide range of high intensity radiant burners with ultra low $NO_x$ emissions. This novel apparatus can be used as a radiant burner in boilers, water heaters, industrial furnaces, and others such as gas fired appliances utilizing high radiation energy. This device operates in a wide range of operating parameters such as calorific intensity and equivalence ratio with ultra low $NO_x$ emissions. It also produces a stable, uniform high radiant flux from the burner surface.

A variety of burners which provide a surface combustion of premixed fuel (vapor or gas) and air or pure oxygen mixtures have been developed, based on using porous materials. For example, a metal mat, screen, fiber matrix, and soft or solid ceramic mat or other structures, may be used as a part for these burners. They provide a premixed flame which burns within, or in close contact with, a ceramic or metallic support that is heated to incandescence. The potential benefits of these types of burners are the ability to perform high efficiency combustion with strong and uniform radiant flux and low $NO_x$ emission.

It is believed that one of the reasons these burners produce low $NO_x$ emissions is that when surface combustion occurs, a large portion of energy is given out as radiation from the burner surface. According to some estimations the maximum radiant efficiency, which is defined as maximum radiant flux/thermal input ratio, is about 30–50% for ceramic fiber burners and 25% for metal fiber burners. High radiation flux dissipates heat from the surfaces. Consequently, the burner surface temperatures were estimated between 1100° and 1650° K. which is less than open flame burner temperatures, resulting in lowered thermal $NO_x$ formation. Typically, $NO_x$ emission from the novel porous burners is less than 30 ppm which is less than the South Coast Air Quality Management District's (SCAQMD) requirement for natural gas-fired water heaters, small industrial, institutional, and commercial boilers, steam generators, and process heaters.

Unfortunately, well known radiant burners provide a combustion with a high radiant efficiency in a narrow range of calorific intensity usually from 20,000 BTU/h·ft$^2$ (63 kW/m$^2$) to 100,000–200,000 BTU/h·ft$^2$ (315–630 kW/m$^2$), and equivalence ratios between 0.8 and 1.2. Outside these ranges of equivalence ratio, flames unstably lift up from the mat surface until, eventually, the entire flame lifts up, and the surface becomes non-radiant.

Equivalence ratio is the ratio of air supplied for combustion to the theoretically (stoichiometrically) required amount of air for complete oxidation of the fuel, e.g. the equivalence ratio, $\lambda=1.0$, is stoichiometric amount of air, while $\lambda$ less than 1 is a fuel rich flame and $\lambda$ greater than 1 is a lean flame.

Also, it should be mentioned that at higher thermal loadings the range of equivalence ratios at which the burner is radiant decreases until eventually the flame lifts off the surface at all equivalence ratios. As a result of this phenomenon the one major disadvantage of well-known radiant burners is poor turndown, i.e. the range of heating rates that can be stably maintained. Many radiant burners are able to work with fixed fuel input, others usually have turndowns of not more than 3:1. Other deficiencies for some of these burners are potential flashback problems, high pressure drop, low mechanical strength, thermal shock fragility, and high cost (even though they are lower in cost than traditional burners).

It is easier to get low $NO_x$ emissions at high equivalence ratios, but this is less efficient because the appliance is heating excess air. One can recover the heat with larger, more costly heat exchangers, but again, that adds to the cost of the appliance using the burner. It is well known that $NO_x$ increases as the heat output of the burner increases. It is desirable to increase heating rate without increasing $NO_x$ emissions. This means, for example, that a larger capacity and cheaper boiler may be housed in a smaller space.

It is therefore desirable to provide low $NO_x$ combustion in porous burners with high radiant emission in a wide range of fuel input and equivalence ratios which are lower in cost than conventional burners such as the shell metal fiber and Alzeta's Pyrocore type fiber matrix. It is also desirable to develop burners which have high thermal shock resistance adequate mechanical strength, and provide high radiant output for a variety of applications including but not limited to:

TPV generators

TPV-powered boilers, water heaters, etc.

Boilers, water heaters, etc.

Industrial furnaces;

Other gas-fired appliances.

BRIEF SUMMARY OF THE INVENTION

There is, therefore, provided in the practice of this invention according to a presently preferred embodiment an advanced emissive matrix ultra low $NO_x$ burner. Such a radiant burner comprises a first porous distributive layer, one face of which receives a fuel/air mixture. A second porous emissive layer having a larger porosity than the porosity of the first layer is spaced apart from the first layer to leave an open combustion zone space between the layers. The fuel/air mixture is delivered to the first porous material layer at a sufficient velocity for maintaining a flame front downstream from the first layer, which thereby remains cool and prevents backflash. The flame front may be stable in the open combustion zone space between the layers or at the emissive layer. The distance between layers may be adjustable. Preferably, there are multiple porous emissive layers spaced apart from each other. The outer (downstream) emissive layers have open area through which radiation from the inner emissive layer(s) can radiate.

In effect, this invention provides a radiant burner that is a three dimensional matrix of two dimensional emissive layers. Each of the emissive layers comprises a two dimensional porous layer. There are open spaces between each of the successive emissive layers. A fuel/air mixture is delivered to an upstream face of a porous distributing layer upstream from the emissive layers. The fuel/air mixture has a sufficient velocity for maintaining a stable flame adjacent to the two dimensional porous layers. Two or more such spaced apart emissive layers may be used. Preferably, each successive layer in a downstream direction has a greater open area than the preceding upstream layer.

In an exemplary appliance such as a water heater, a burner comprises two or more separate layers of porous structures. For the first distributive layer, wire cloth, ceramic fiber or perforated solid ceramic materials, a metal matrix or other similar materials can be used. The second layer (emitter-stabilizer) has much more open area and it can be made from different highly refractory materials like, for example, refractory metal screen or a ceramic. The emitter-stabilizer is used for flame stabilization and as a means for transferring energy to a target by radiation, and for heat dissipation away from the flame zone.

In one application, i.e. thermophotovoltaic generation, the emitter-stabilizer(s) can be made from superemissive substances, like ytterbia, or coated with such substances which emit a selected band of photons for optimum absorption by photovoltaic cells.

The relationship between the porosity of the first and second layers can be a means for providing additional control for keeping a high level radiant mode of the burner at different fuel inputs. The width of the gap between the layers may be used as a means for controlling thermal loading. Thus, another novel feature comprises means for controlling at least one of the gap distances between the porous layers. When fuel input increases, the distance between layers should be extended; lowering fuel input may be accompanied with the decreasing of the gap.

In the case of using a flexible ceramic (like ceramic fiber mat) as a first layer, which is preferable to solid ceramic in terms of avoiding thermal shock, some additional support can be installed underneath the soft or fragile materials to form a laminated or composite structure.

If desired, a heat exchanger can be provided inside the first layer or below it for additional protection against flashback. In some cases it is possible to combine a heat exchanger with the solid support of the ceramic layer in one element. As a cooling agent, a utility fluid can be used when the burner operates in boilers or water heaters. In a thermophotovoltaic (TPV) application it is possible to use outlet water from the photovoltaic sink as a cooling agent.

Additional ways to avoid a flashback are to use fiberglass or similar materials placed in the space below the first porous layer, to utilize an anti-flashback agent inside the fiber matrix or supporting element, or by coating the fiber matrix or support with thermal reflective materials.

DRAWINGS

These and other features and advantages of the present invention will be appreciated as the same becomes better understood by reference to the following detailed description when considered in connection with the accompanying drawings wherein.

DETAILED DESCRIPTION

Figure 1:
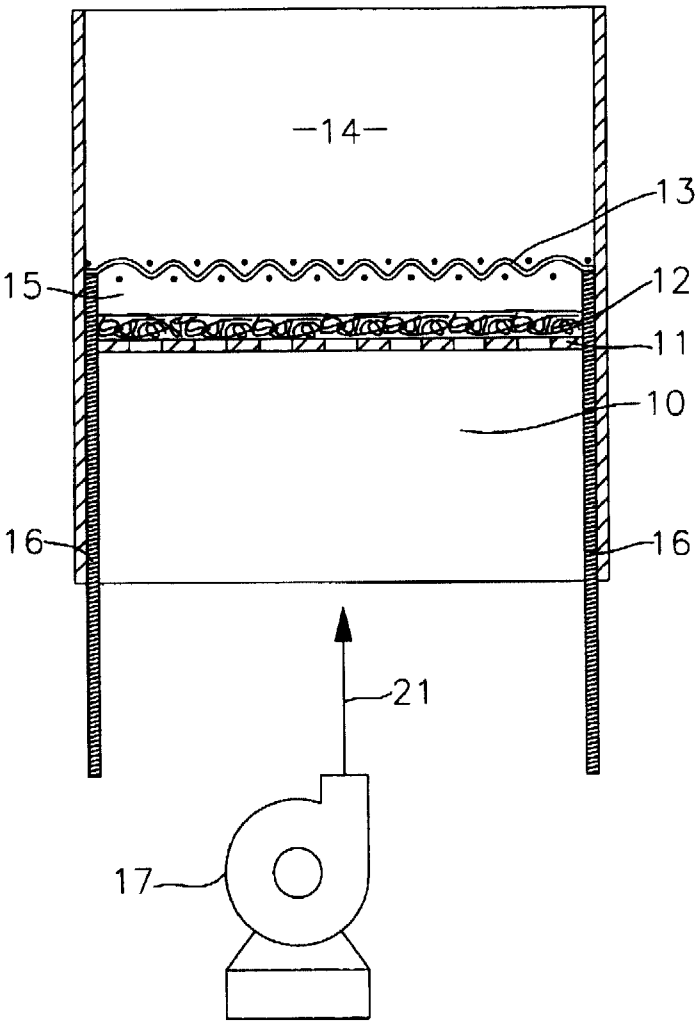
FIG. 1 illustrates in schematic transverse cross-section a burner constructed according to principles of this invention.

FIG. 1 illustrates schematically one design of an advanced emissive matrix ultra low $NO_x$ burner which has a combustible mixture plenum 10. A solid support such as perforated metal 11 is at one side of the plenum. A soft porous layer of ceramic fiber 12 such as glass or aluminum oxide fiber is supported on the perforated metal. A porous emitter-stabilizer layer 13 of refractory material such as Kanthal is adjacent a post combustion chamber 14. A gap 15 (precombustion chamber) is formed between the two porous layers 12 and 13. The distance between layers 12 and 13 is controlled by means of gap control rods 16. This flexible design may be easily modified for a particular application by a change in the size of the gap 15, by varying the porosity of the layers, or by altering the position or replacing the movable emitter-stabilizer 13.

Premixed fuel/air mixture 21, such as natural gas and air, is introduced into the combustible mixture plenum 10 by means of a blower 17 and passed through the perforated structure of the first layer such as metal wire screen 11 and ceramic fiber 12, then ignited at the surface of the second porous layer 13. The flame stabilizes on the emitter-stabilizer and the flame front occurs inside of the gap 15 or just behind the emitter-stabilizer. The emitter 13 (such as a high temperature metal screen, ceramic structure or composite) begins to emit light energy and cools the flame zone, causing a temperature drop and as a result low $NO_x$ emission.

In the case where fuel input needs to be corrected over usual turndown ranges the width of the changeable gap 15 between the porous layers may be adjusted by means of gap control rods which move the emitter-stabilizer up and down. Whereas existing burners typically have a turndown ratio 3:1, such a novel burner can have a turndown ratio of as much as 10:1. In other words, the heat output from the burner may be adjusted over a range from full power to a little as one tenth of full power. The same procedure may be performed if it is desired to keep a radiant mode of the burners at a selected equivalence ratio over traditional ranges at some fixed or varied fuel input.

In this burner, the flame front of combustion is always downstream from the first layer. The flame front may be in the second layer, but preferably it is in the space between the layers. In the event there are intermediate porous layers as hereinafter described, the flame front may be in an intermediate porous layer. The location of the flame front depends at least in part in the velocity of the premixed fuel-air mixture. The flame front occurs at the location where the flame velocity moving upstream in the gas exactly equals the gas flow velocity.

The gas between the layers absorbs only a small amount of radiation. Radiation from the second layer impinges on the first layer and heats it. If the first layer gets too hot, flashback may occur. If the layers are too close together, the first layer may get too hot and cause flashback. At higher BTU levels, one needs more space between layers than at lower BTU levels. Basically, the temperatures are lower and there is less radiation at lower heating rates and greater spacing is needed when the heating rates are higher.

The first layer absorbs radiation and transfers this heat to the gas. Gas flowing through the first porous layer cools the first layer as it preheats the gas before it reaches the flame front. The first layer with limited porosity also provides a pressure drop and the gas expands upon leaving the first layer. This expansion also cools the gas after it flows through the first layer and helps minimize heat flow back toward the first layer.

Figure 2:
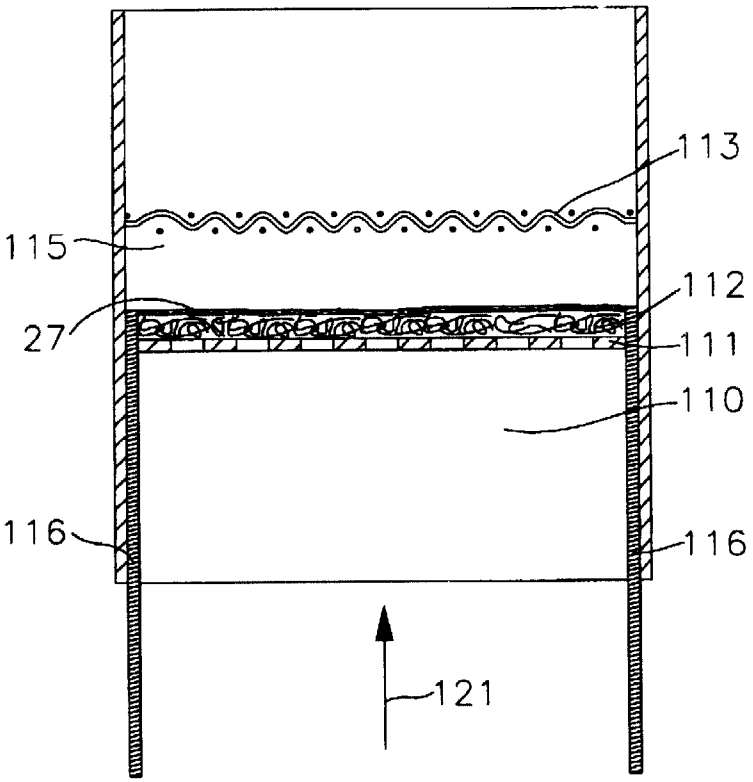
FIG. 2 illustrates in schematic transverse cross-section another exemplary variation of the burner.

A generally similar arrangement is illustrated in FIG. 2, in which like parts are identified by reference numerals 100 greater than the reference numerals identifying the same parts in FIG. 1. Thus, for example, the emitter-stabilizer 113 in FIG. 2 corresponds to the emitter-stabilizer 13 in FIG. 1. In this embodiment the gap control rods 116 adjust the first porous layer for varying the gap between the layers.

The arrangement illustrated in FIG. 2 has an additional feature, namely a reflective coating 27 covering the top of the first porous structure 112. Such a reflective coating may be, for example, a thin layer of gold, platinum, rhodium, MgO, $TiO_2$, $Al_2O_3$ or the like deposited on the surface of the porous layer by spray coating, chemical vapor deposition or the like. This arrangement enhances the protection of the burner against flashback due to reflecting part of the radiant emission from the emitter-stabilizer, thereby keeping the first layer cooler.

Figure 3:
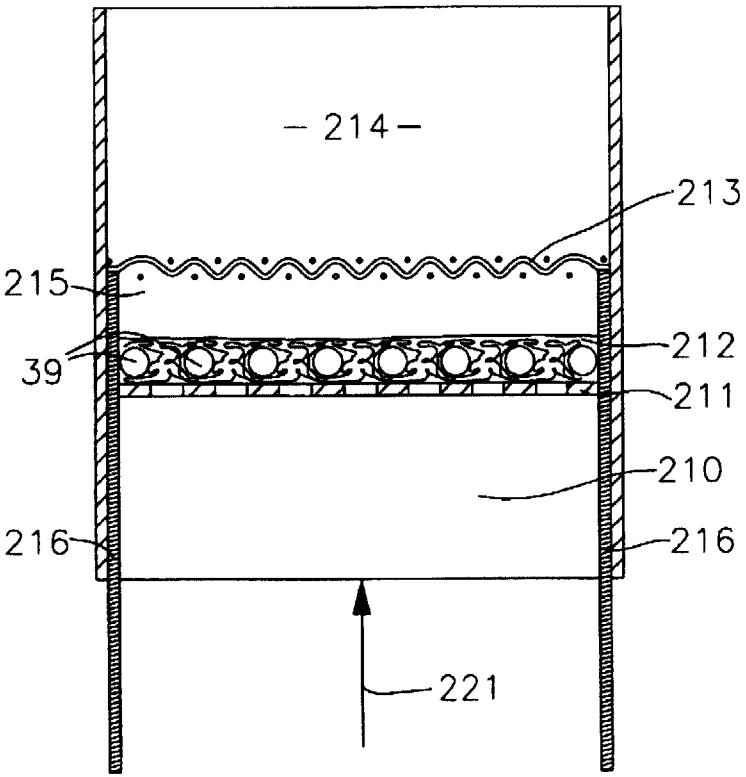
FIG. 3 illustrates in schematic transverse cross-section another embodiment of burner.

FIG. 3 schematically illustrates another embodiment of the burner design with a flashback protective heat exchanger that is inserted inside of a first ceramic fiber layer. All three parts-solid support 211, water cooled heat exchanger 39, and ceramic fiber matrix 212 may be integrated in one element, for example, by means of vacuum forming technology. This arrangement enhances reliability of the burner in terms of flashback protection and simultaneously produces hot water.

Figure 4:
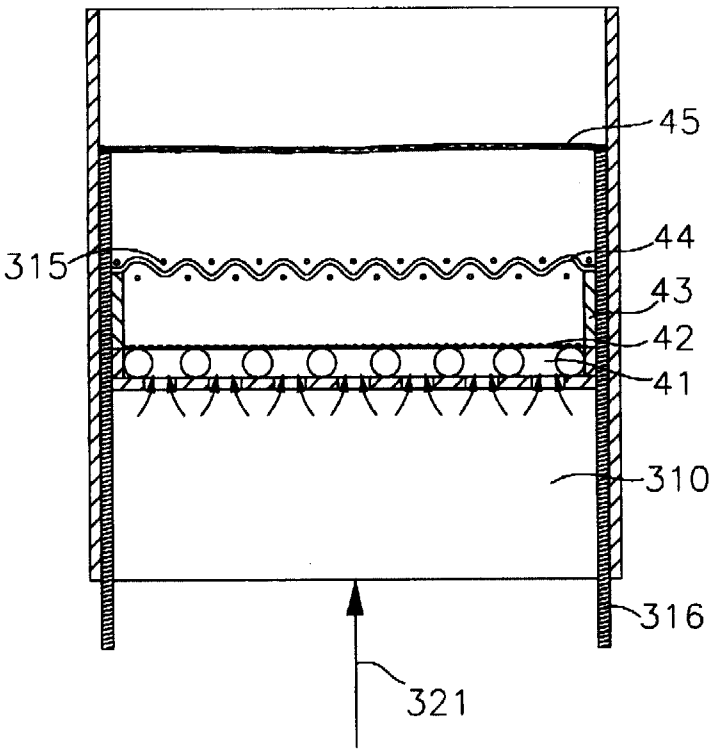
FIG. 4 illustrates in schematic transverse cross-section a burner with multiple emissive layers.

An optional additional protection against flashback may be provided by using an intermediate reflector together with heat exchanger such as schematically illustrated in FIG. 4. This apparatus comprises a combustible mixture plenum 310 for receiving a fuel-air mixture. At the outlet side of the inlet plenum there is a heat exchanger 41 such as tubing for carrying water. A wire cloth, for example, a twilled weave layer 42 provides a first porous layer in the burner.

Within a variable gap 315 between the first porous layer and a second porous "emitter-stabilizer" layer 45, there is a frame 43 with intermediate reflector-turbulizer. The turbulizer comprises baffles or the like which produce turbulence in the gas flowing through the gap. Exemplary turbulizer baffles comprise twisted ribbons or wavy sheets which deflect gas flow and produce turbulence. The turbulizer helps stabilize the flame front, increases residence time of gas in the burner and improves heat transfer.

In this embodiment a "radiant emission shield" 44 such as a metal screen coated with reflective materials is also mounted on the frame. The third porous layer in the space between the first and second layers should have a porosity no greater than the porosity of the second layer so that, generally speaking, there is increasing porosity from the first inlet distributor layer to the final outlet layer. Combustion gases from the second porous layer pass into a post combustion chamber 314. Gap control rods 316 are used for moving the second porous layer 45 for varying the width of the gap 315.

To provide more effective protection of the high porosity wire cloth 42 against radiant emission from the porous emitter-stabilizer layer 45, the intermediate screen 44 can be made from or coated by reflective materials. The porous emitter-stabilizer layer can be made of the same structure as the intermediate screen, or other low thickness, high temperature resistive materials with more extensive porosity than the first layer 42 can be used. If this invention operates as part of a thermophotovoltaic (TPV) unit, the emitter-stabilizer layer 45 can be made from or coated with superemissive materials such as ytterbium oxide which have narrow band emissions readily absorbed by the photovoltaic cells.

Inserting an additional screen 44 between the emitter-stabilizer 45 and the tightly woven wire cloth first layer 42 improves flame stability and permits wider turndown ratios. A majority of known radiant burners have a turndown not more than 3:1 with maximum fuel input rate of about 200,000 BTU/h·ft$^2$ (630 kW/m$^2$). An experimental burner with an intermediate reflector-turbulizer placed at about 12 mm below the emitter-stabilizer operated quite well from 100,000 to 1,070,000 BTU/h·ft$^2$ (315 to 3375 kW/m$^2$) (turndown greater than 10:1) without any problem in terms of flame stability even with a fixed gap of about 30 to 35 mm.

In a preferred embodiment the width of the gap between layers should be relatively large between the porous distributive layer and the first emissive layer, as compared with the width of the gap between successive emissive layers. For example, the gap between the distributive layer and the first emissive layer may be in the range of from about 20 to 35 mm. If the gap is too narrow, there may be excessive heating of the distributive layer enhancing the possibility of flashback. The gap or gaps between successive emissive layers may be in the range of from about 5 to 12 mm. Generally speaking, gaps may be higher for higher heating rates.

Figure 11:
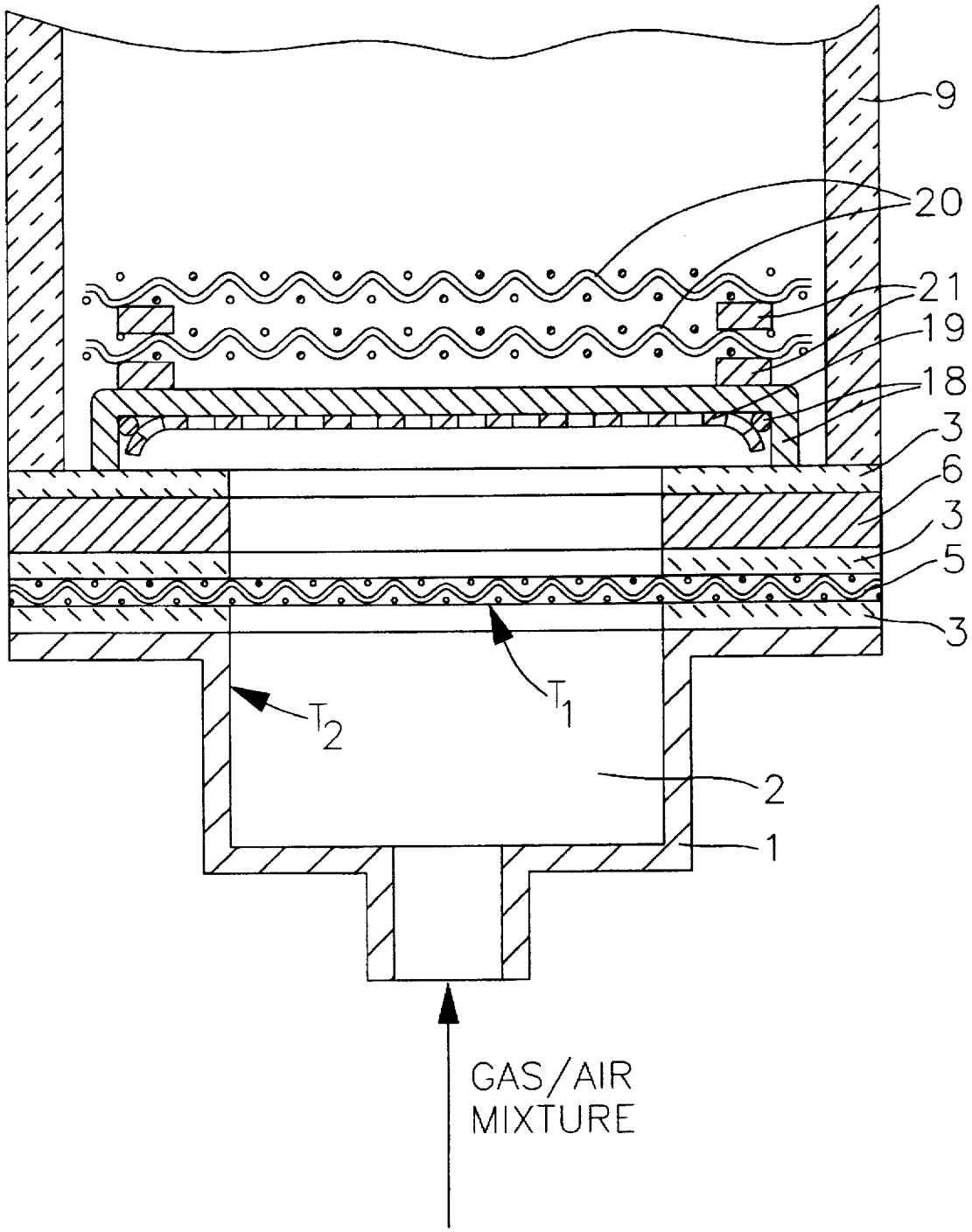
FIG. 11 illustrates in schematic transverse cross-section a second embodiment of experimental burner.
Figure 12:
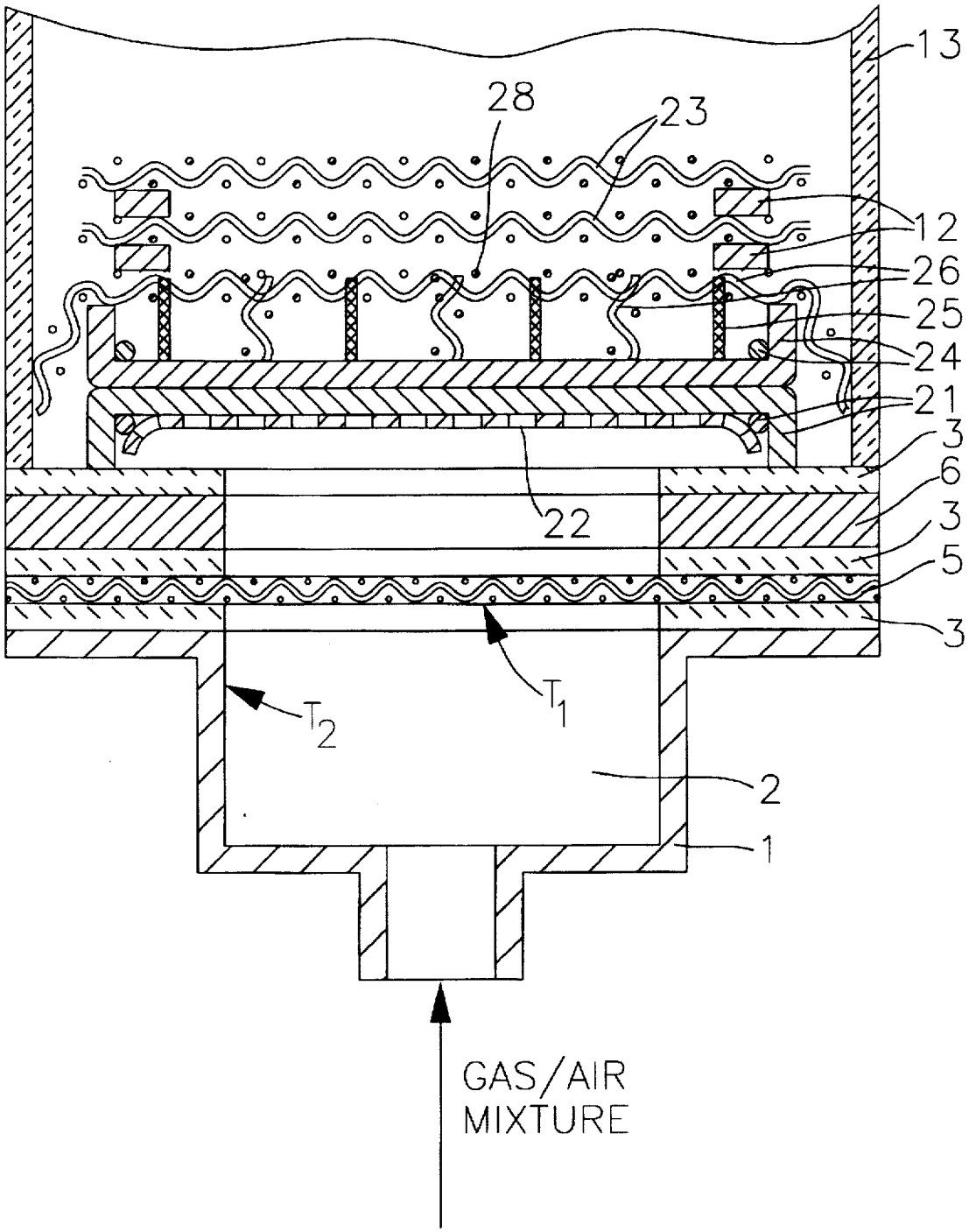
FIG. 12 illustrates another embodiment of experimental burner.

A burner with multiple emissive layers as illustrated in FIG. 4 or in FIGS. 11 and 12 proves to be a highly effective emitter of radiant energy with low $NO_x$ emissions. In prior fiber matrix or other porous burners, there is a flame front which typically occurs only close to the surface of the porous matrix. At least the outer surface of the porous matrix is heated to an elevated temperature and radiates energy. A porous matrix burner is effectively opaque and radiates from its surface or from only a limited depth below the surface.

A burner with more than one porous layer is provided in practice of this invention as multiple two dimensional emissive layers. An exemplary burner has two emissive layers of Kanthal wire screen downstream from the porous distributive layer through which gas is introduced in the burner. There is an appreciable pressure drop through the distributive layer and consequent adiabatic cooling of the fuel/air mixture. Combustion typically commences at the first porous emissive layer and continues at the second porous layer. Upstream from the first layer the gas velocity is higher than the combustion front velocity in the relatively cool gas. Combustion at the first emissive layer however, heats the layer to elevated temperature and a substantial portion of the combustion occurs in proximity to the first heated layer. Combustion continues downstream from the first layer but is believed to occur at a lower rate because the gas is somewhat cooler than at the incandescent first layer.

The second layer is heated by combustion and by radiation absorbed from the first layer. In this case the resulting high temperature promotes combustion in close proximity to the second layer.

In this embodiment the second layer has a relatively higher porosity than the first layer. Such a layer made of wire screen (or perforated ceramic felt) can be considered to be a two dimensional burner surface which radiates from the area occupied by the wires and is effectively transparent in the open areas between the wires. Thus, the second or downstream layer of wire screen has a sufficient open area that substantial radiation from the upstream first layer radiates through to provide radiation from the burner. Any radiation absorbed by the wires of the second layer is re-radiated. Some of this of course, is radiated back toward the first layer where it is either reflected or absorbed and re-radiated.

Thus, the radiant burner is, in effect, a multi-layer porous burner with spaces between the layers. Radiation can occur from each of the layers rather than simply the outermost layer as is customary in a porous matrix burner. It is believed that in such an arrangement, a principal portion of the burning may occur at each of the porous layers, with less combustion occurring between layers. This produces high efficiency. Furthermore, since each of the layers can effectively radiate, the peak flame temperature can be minimized and the $NO_x$ emissions minimized over a broad range of turndown.

In addition to being more open i.e., transparent to radiation, in some embodiments it is also desirable that the second emissive layer have less mass than the first emissive layer. What one desires, is to have the heat generation adjacent to the location where heat is removed from the burner. This, of course, occurs at the emissive screens and it is desirable to maximize the heat radiated from the various layers of the burner. It turns out, with a multiple layer burner or assembled matrix having, in effect, a plurality of two-dimensional layers, that heat generation at the successive layers is converted to radiation efficiently and maintains an approximately uniform temperature throughout a broad turndown range.

What is provided is, in effect, a three-dimensional porous matrix made up of a plurality of two-dimensional porous structures spaced a short distance apart from each other. To some extent the burner can be made more three-dimensional by also providing wires, screens, or similar radiant structures extending in the direction of gas flow through the burner. Such an arrangement is illustrated in FIG. 12 for example, which has a plurality of metal legs and strips of wire screen which extend parallel to the direction of gas flow.

The "two-dimensional" layers may themselves have appreciable thickness and mass. They might almost be considered as porous matrixes themselves, however, the porosity is very much larger than a fiber matrix burner, for example. Open areas of from 30 to 90% in each layer are suitable. Individual layers may be a few millimeters thick. Relatively thick "two-dimensional" layers forming a matrix burner are described hereinafter and illustrated in FIG. 17.

An exemplary burner has a relatively low porosity distributive layer at the upstream end. This may have a porosity or open area of as low as 8 to 10% and appreciable thickness so that there is a substantial pressure drop across the distributive layer. This may be desirable to promote sufficient cooling as the combustible mixture expands through the layer to keep the distributive layer cool despite absorption of radiation from the downstream emissive layers. The flame stabilizes on the downstream emissive layers which, as explained above, are at elevated temperature and hence provide a location for the principal combustion. The flame remains stable over a broad turndown range with such a burner construction. At a higher gas flow rate, there is more cooling as the fuel-air mixture expands through the distributive layer. There is also a higher gas velocity which exceeds the flame velocity. The flame velocity, however, also increases with increasing heating rate. The flame velocity is about the same as the gas velocity, which is believed to be a principal reason for the great stability of the flame over a broad range of turndown.

The porosity of the emissive layers downstream from the distributive layer, i.e. the open area when the layer is considered as a two-dimensional layer, is in the range of from about 30–90%. Thus, as compared with the lower porosity three-dimensional distributive layer, there is a relatively low pressure drop at each of the emissive layers.

The description of a three-dimensional matrix burner as a plurality of two-dimensional emissive layers spaced apart from each other, has been in the context of two such emissive layers as illustrated in FIG. 4. It will be apparent that there may be additional emissive layers making up a three-dimensional burner, such as hereinafter described and illustrated in FIG. 12.

Where high heat flux with low $NO_x$ production is desired, the porosity of successive emissive layers downstream from the distributive layer preferably increases in successive layers. An indication of the porosity of the layers is given by the back pressure as gas flows through the layers. Table 1 indicates the back pressure in inches of water column as a function of gas flow rate in standard cubic feet per hour for several materials. The flow area was seven square inches. Testing was at ambient temperature. Data for pressure drop measured at ambient temperatures is suggestive of the pressure drops that may occur at elevated temperature, but it will be apparent that pressure drop is somewhat more complex because of the high gas velocities, combustion reactions and elevated temperatures adjacent to the porous screens.

TABLE 1

| | Air Flow SCF/h | | | | | |
|---|---|---|---|---|---|---|
| Material | 735 | 1040 | 1280 | 1471 | 1650 | 1801 |
| NOTHING (100% open area) | 1.60 | 2.95 | 4.35 | 5.85 | 7.20 | 8.55 |
| KANTHAL SCREEN | 1.60 | 2.95 | 4.35 | 5.85 | 7.20 | 8.55 |
| PERFORATED ZR FELT | 1.61 | 3.10 | 4.60 | 6.05 | 7.45 | 8.85 |
| NEXTEL | 2.10 | 5.80 | 8.40 | 11.15 | 13.55 | 16.25 |
| Twilled weave | 5.35 | 9.33 | 13.00 | 17.06 | 20.75 | — |

The first listing in the table is for an open burner apparatus, i.e. without any layer that impedes gas flow. The least back pressure, i.e. highest porosity, is from a Kanthal screen having about 64% porosity. The tests were not sufficiently sensitive to measure any back pressure contribution from the refractory metal screen. Another suitable emissive layer comprises perforated zirconia felt having about 33% open holes (as described hereinafter). The zirconia felt shows a slightly higher, but still low back pressure.

A suitable distributive layer described hereinafter is a woven ceramic fabric known as Nextel 312. It is a woven fabric of alumina-boria-silica fibers. This fabric has a back pressure significantly greater than either of the emissive layers. A preferred distributive layer comprises a stranded Dutch-twill weave of refractory metal fibers (estimated at 10% porosity). Such a twill has low porosity, and as can be seen from Table 1, a substantial back pressure.

An exception to increasing porosity in an outer emissive layer as compared with a third layer between the outer emissive layer and the distributive layer is an embodiment where energy is recovered via photovoltaic cells. In such an embodiment it is desirable to have a high temperature on the outermost layer or layers for more efficient radiant energy transfer to the photocells. To achieve such higher temperatures, the porosity or open area of the downstream layer is smaller than the open area of the upstream layer(s).

Figure 5:
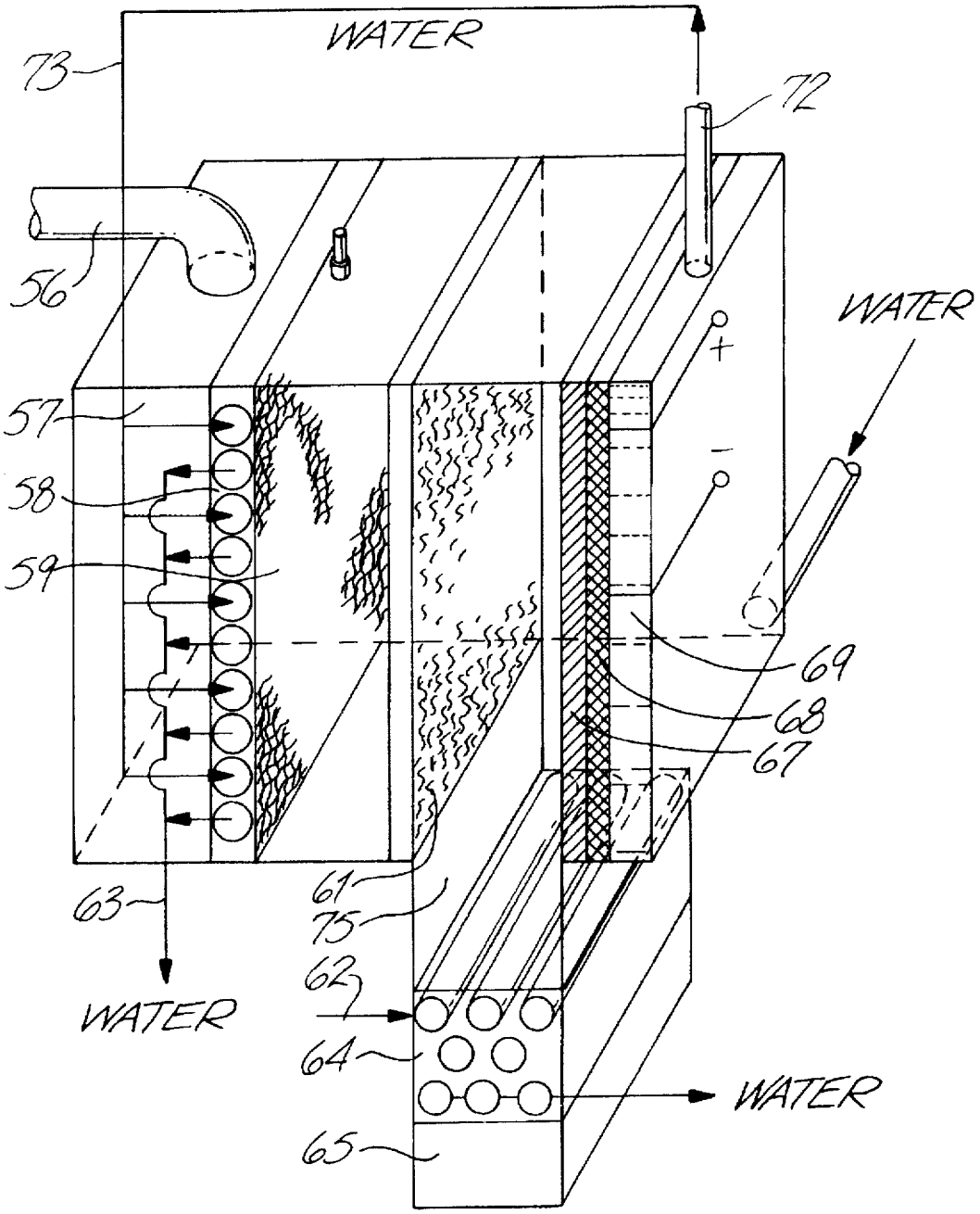
FIG. 5 illustrates in isometric cross-section application of the burner in apparatus for heating water and generating electricity.

FIG. 5 schematically illustrates in cutaway isometric a representative part of a self-powered water heater with a low $NO_x$ wide range calorific intensity radiant burner. There are three main elements: a radiant burner with a narrow band selective emitter, a power generation section, and a convective heat exchanging area with a heat exchanger.

The radiant burner comprises an inlet gas-air mixture fitting 56 for introducing a combustible mixture into a plenum 57. The fuel-air mixture flows through a flashback protective water cooled heat exchanger 58 and a first porous layer, e.g., stranded twilled weave wire cloth layer 59. An emitter-stabilizer 61 made from or coated by superemissive materials like ytterbia or the like forms the outlet face of the burner.

The power generation section includes a photovoltaic (PV) cell matrix 68 with a water cooled heat sink 69 behind the cells and a protective glass 67 between the cells and burner. A protective transparent material such as a high temperature glass 67 is used for separation of the PV cell surface from hot waste gases and can be made as an optical filter that is transparent in the spectral region of the narrow band selective emitter which is matched to the absorption spectrum of the PV cell. It protects the PV cells against thermal degradation and enhances their conversion efficiency.

A convective heat exchanging area comprises a post combustion chamber 75, a finned heat exchanger 64, and a vent duct 65.

A combustible mixture is introduced into the burner through the inlet gas-air mixture fitting 56, passed through the open area of flashback protective heat exchanger 58, and high porosity inlet layer 59 that can be made of stranded twilled weave wire cloth. The combustible mixture is ignited and burned in an area near the emitter-stabilizer 61. At high temperatures, the superemitter 61 that is made of a rare earth metal oxide emits photons which are collected by the photovoltaic cell 68 and converted by the PV cell into electrical power. The PV cell is protected from the post combustion chamber 75 by the thermally resistant glass 67 or special optical filter. The back side of the PV cell 68 is cooled by the water cooled sink 69. This arrangement keeps the temperature of the PV cell low for enhancing its conversion efficiency. Waste gases are directed into the main heat exchanger 64, then evacuated through the vent duct 65.

This novel TPV design has an advantage over TPV technologies utilizing ceramic fiber burners. A difference between the two techniques is that the new technology separates an emissive surface from the ceramic fiber body which is actually a sort of gas-air mixture distribution structure.

Ceramic fiber or solid ceramic burners with superemissive surface are able to operate in narrow ranges of fuel input and equivalence ratio due to strong dependence of the burner's radiant mode on speed of the gas-air mixture that is passed through the porous ceramic body of the burner. When flame propagation velocity is equal or close to the speed of the combustible mixture, flame occurs at the surface of the superemissive layer and the burner works in the desired radiant mode. If the speed of the combustible mixture is over the flame propagation velocity, the flame lifts up from the surface and the burner changes from radiant mode to blue flame mode that does not produce a flux of light energy. If the speed of the combustible mixture is lower than flame propagation velocity, burning occurs inside of the porous ceramic body and the flame penetrates deeper until it causes flashback, due to overheating a burner body, if not stabilized by some means.

Conversely, the new burner provides a special "buffer", or precombustion area in the changeable gap between the porous layers. This arrangement allows use of the first layer of the burner only as a distribution element. The speed of the combustion mixture decreases after the mixture is introduced into the "buffer" area, then speeds up when the mixture passes through the emitter-stabilizer. Hence, inside of the region that is formed by the first (distribution) and second (emissive-stabilization) layers there is a nonuniform distribution of the speed of the combustible mixture. In other words, there are a variety of mixture speeds and there are more possibilities for flame to find the "right place" for stabilization, where flame propagation velocity is equal to the speed of the mixture.

From another point of view, a stabilizer creates turbulence that works like an additional stabilizing factor. All of these features provide the ability for significant widening of the fuel input and equivalence ratio ranges, even though the changeable gap may be fixed. As mentioned above, the invention reaches a turndown ratio of 10:1, e.g., in a laboratory scale burner with the maximum fuel input of about 2,000,000 BTU/h·ft$^2$ (6.3 mW/m$^2$).

When the size of the gap is changed we have an additional means of controlling the flame stabilization process with a range of turndown greater than 10:1.

A second benefit of splitting emissive and distributive layers is the ability to insert between them one or more intermediate bodies that can be used from one point of view as another turbulizer of the combustible mixture and, therefore, enhancer of stability of the radiant mode of the burner. From another point of view, they could be used as a "radiant emissions shield" that protects the distribution layer, e.g., twilled weaves or ceramic materials, against the flux of the energy that is released from the emitter. This, therefore, increases the reliability of the burner in terms of flashback protection. Another novel feature of this enhancing is that any additional layer 44 (reflector-turbulizer) increases heat dissipation away from the flame, which decreases temperature and $NO_x$ emission.

The embodiment that is illustrated in FIG. 5 reduces heat losses by using a water cooled PV sink and flashback protective heat exchanger. Due to the necessity to keep the PV cell temperature at 30°–35° C. we can use the PV sink outlet water 72 as inlet water 73 for the flashback protective heat exchanger 58. The heat exchanger outlet water 63 can be directed into the main heat exchanger water inlet 62 or used as an individual loop.

Figure 6:
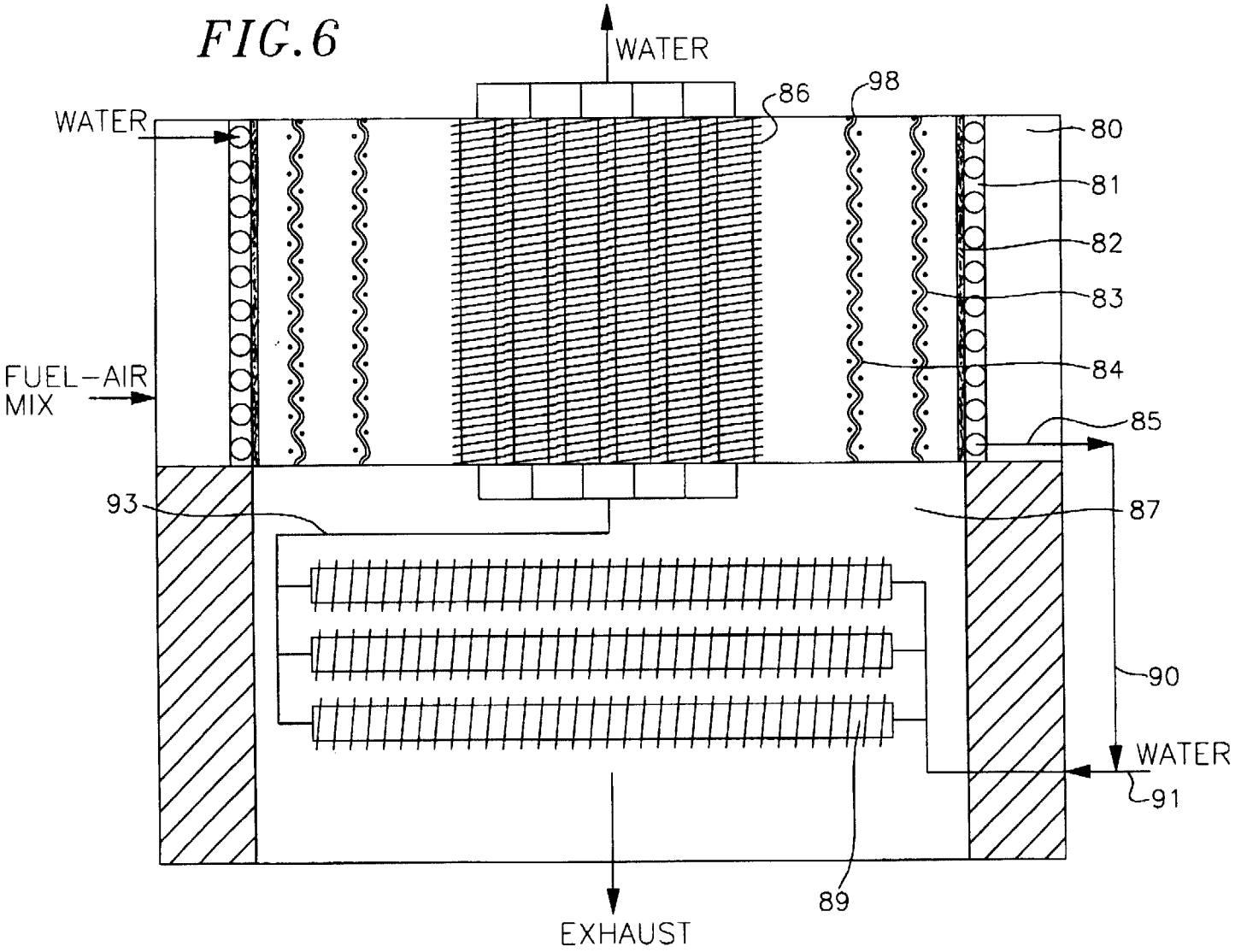
FIG. 6 illustrates in schematic cross-section application of a burner in a water heater.

FIG. 6 semi-schematically illustrates one possible modification of a water heater with the invented burner which has its combustion directed radially inwardly. This water heater comprises an inward firing advanced emissive matrix, ultra low $NO_x$ burner with a heat exchanger that is installed along the axis of the burner and a convectional heat exchanging area with a secondary heat exchanger.

The inward firing burner comprises an annular combustible mixture plenum 80, a flashback protective heat exchanger 81, and a porous distributive layer 82 that can be made of twilled weaves or other wire cloth, perforated metal, porous ceramic materials or composites. An intermediate radiant emission shield-turbulizer 83 made, for example, from Kanthal and coated by some reflective materials is in the annular gap between the distributive layer and a porous emitter-stabilizer layer 84 that can be made of Kanthal or other high temperature resistive material with more extensive porosity than the distributive layer 82.

A first stage finned tube heat exchanger 86 is installed in the middle of the burner and is designed to provide high radiant heat transfer from the emitter of the burner to water circulated through the heat exchanger. According to some estimations, 30–50% of the total energy is released as radiation which can be absorbed by the first stage heat exchanger.

The convectional heat exchanging area comprises a heat exchanger 89 in an insulated duct 87. Depending on fuel input, it is possible to use heat exchangers 86 and 89 in series or as individual loops. The water outlet 85 from the flash-back protective heat exchanger 81 can be directed into the main water input 91 or used individually. The benefits of this design are the ability to build a portable, extremely high capacity, low cost boiler or water heater that allows substantial space saving.

Test data shows that a cylindrical water heater with an inward firing burner with an exterior diameter of 18 inches 45 cm has only a 1.77 $ft^2$ (0.16 $m^2$) footprint, and with a 12 inch (30 cm) diameter burner will be able to reach over 2,000,000 BTU per hour (590 kW). At the same time, a conventional hot water boiler with nominal capacity of 1,800,000 BTU per hour (530 kW) such as model HH 1825 IN 09C1A manufactured by Teledyne Laars has a footprint of 19.2 $ft^2$ (1.78 $m^2$), which is 11 times more.

Figure 7:
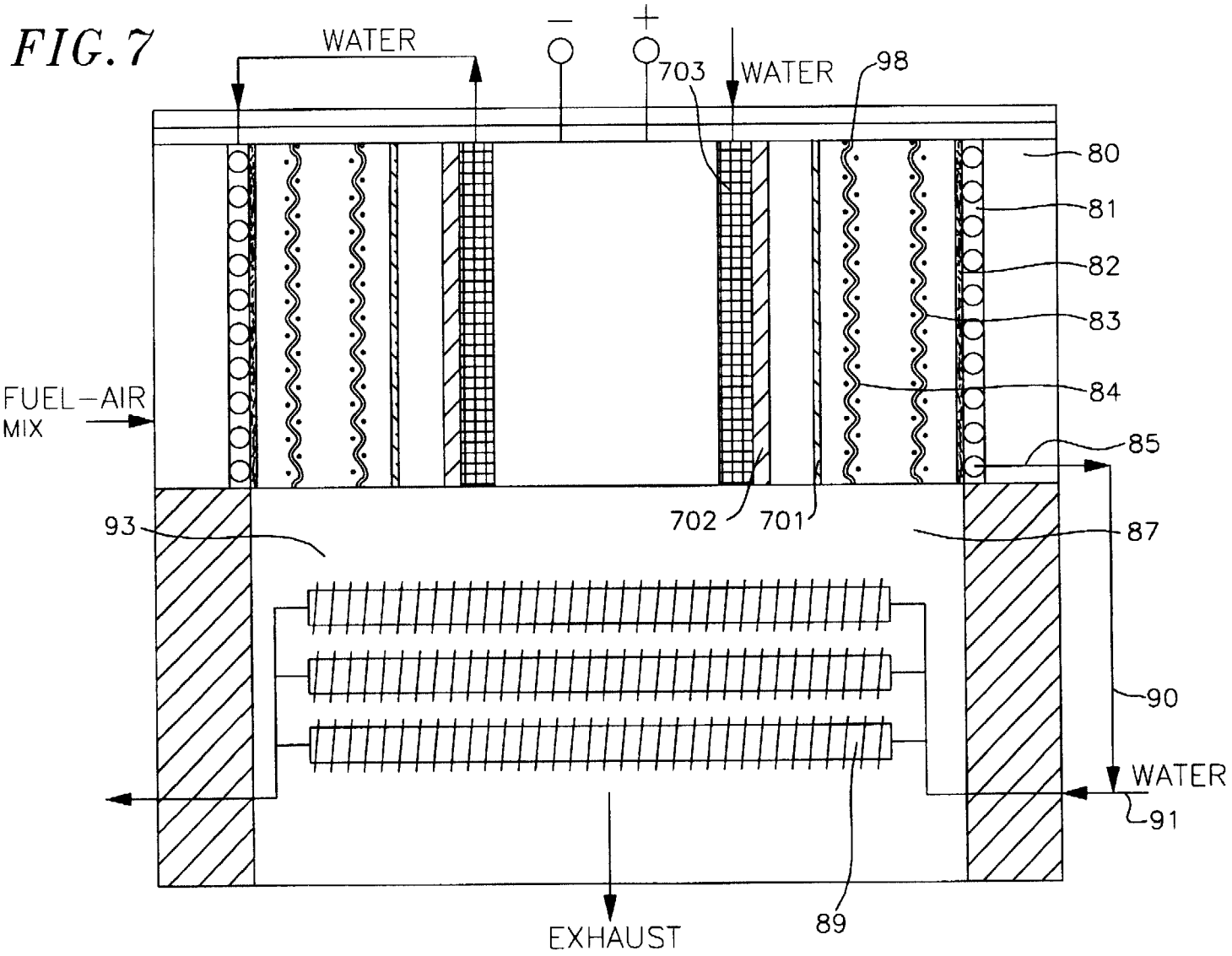
FIG. 7 illustrates application of a burner similar to that in FIG. 6 in a self-powered water heater.

Using the same approach, it is possible to design a compact high-capacity self-powered boiler or water heater and FIG. 7 schematically illustrates this. The embodiment of such a device is similar to the unit illustrated in FIG. 6 but, instead of a heat exchanger in the center of the annular burner structure, there is a protective glass cylinder 701 and a TPV power generation element 702, such as an array of photovoltaic cells, like that in FIG. 5. A difference is that in this embodiment a round water-cooled heat sink 703 with attached photovoltaic cells is used. Furthermore, instead of a simple radiant emitter 98 it is preferred to use a superemitter surface such as a rare earth oxide on at least the burner surface. The quantum emission band from the burner is selected so that it passes through the glass cylinder 701 with little absorption, but has maximum absorption in the photovoltaic cells 702.

Regarding the criteria of low $NO_x$ emission from gas fired equipment, this invention has a significant advantage with respect to well known radiant burners.

Figure 8:
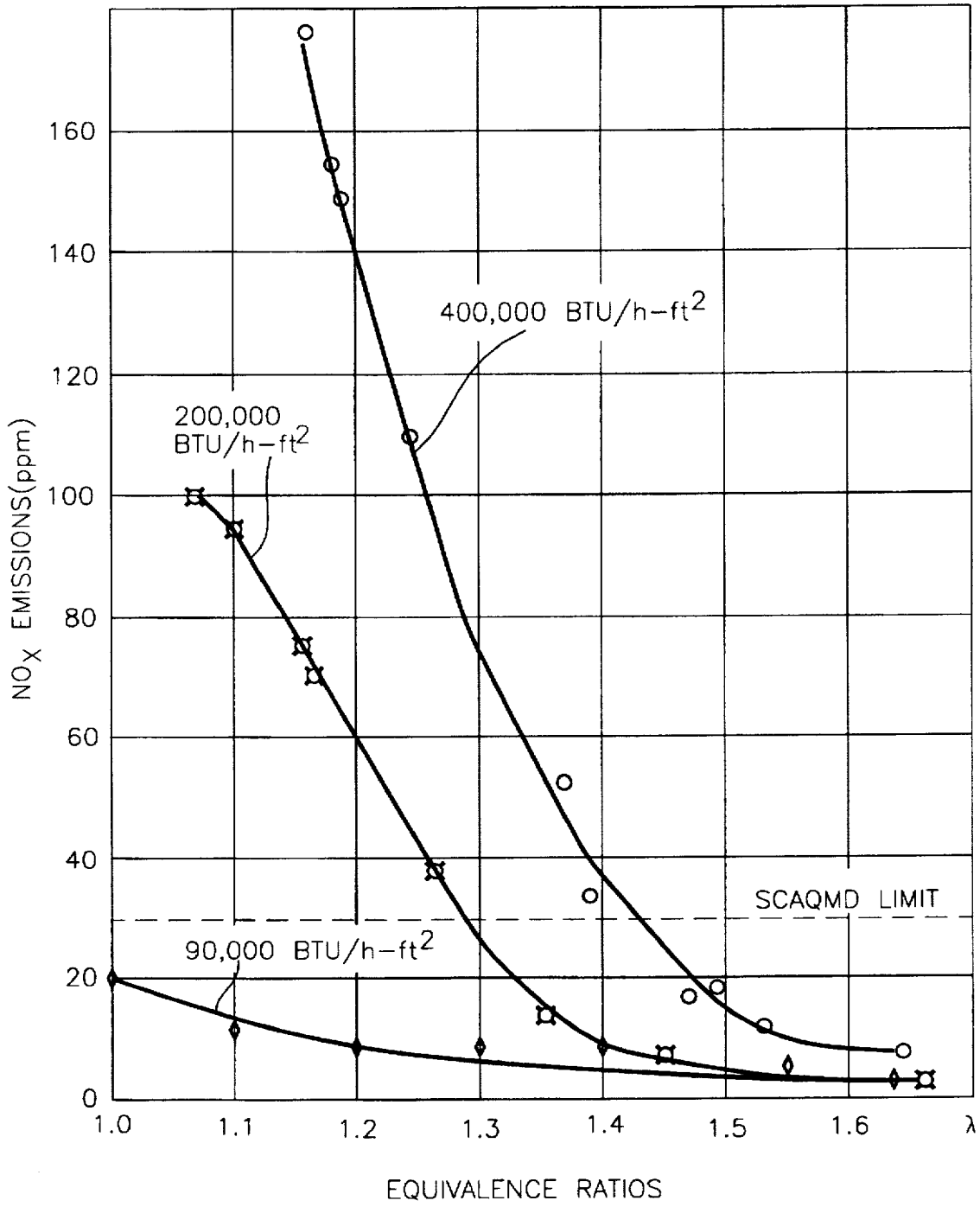
FIGS. 8 and 9 are graphs of $NO_x$ emissions as a function of heating rate and equivalence ratios for various burners.

FIG. 8 illustrates $NO_x$ emissions (in parts per million, ppm) from a ceramic fiber burner at different rates of fuel input versus equivalence ratio. The values plotted for $NO_x$ emissions are shown in accordance with requirements defined by the SCAQMD. This calculation is based on correction of measured concentration of $NO_x$ to 3% oxygen, which corresponds to and equivalence ratio of 1.17 or 17% excess air. Correction to 3% $O_2$ can be done by the formula $$NO_x(\text{ppm at } 3\%\ O_2)=NO_x(\text{ppm at } X\%\ O_2)\ (20.9-3)/(20.9-X)$$

where X is the measured concentration of $O_2$. For example, in FIG. 8, the $NO_x$ concentration at an equivalence ratio of 1.5 and a heat rate of 400,000 BTU/h·$ft^2$ is shown as 19 ppm. The actual $NO_x$ concentration is found by dividing the 19 ppm by the ratio of 1.5:1.17 to yield a $NO_x$ concentration of 14.8 ppm. The $NO_x$ value normalized to 3% oxygen dilution is determined by a ureverse of this procedure after the $NO_x$ and actual oxygen concentration are measured.

Figure 9:
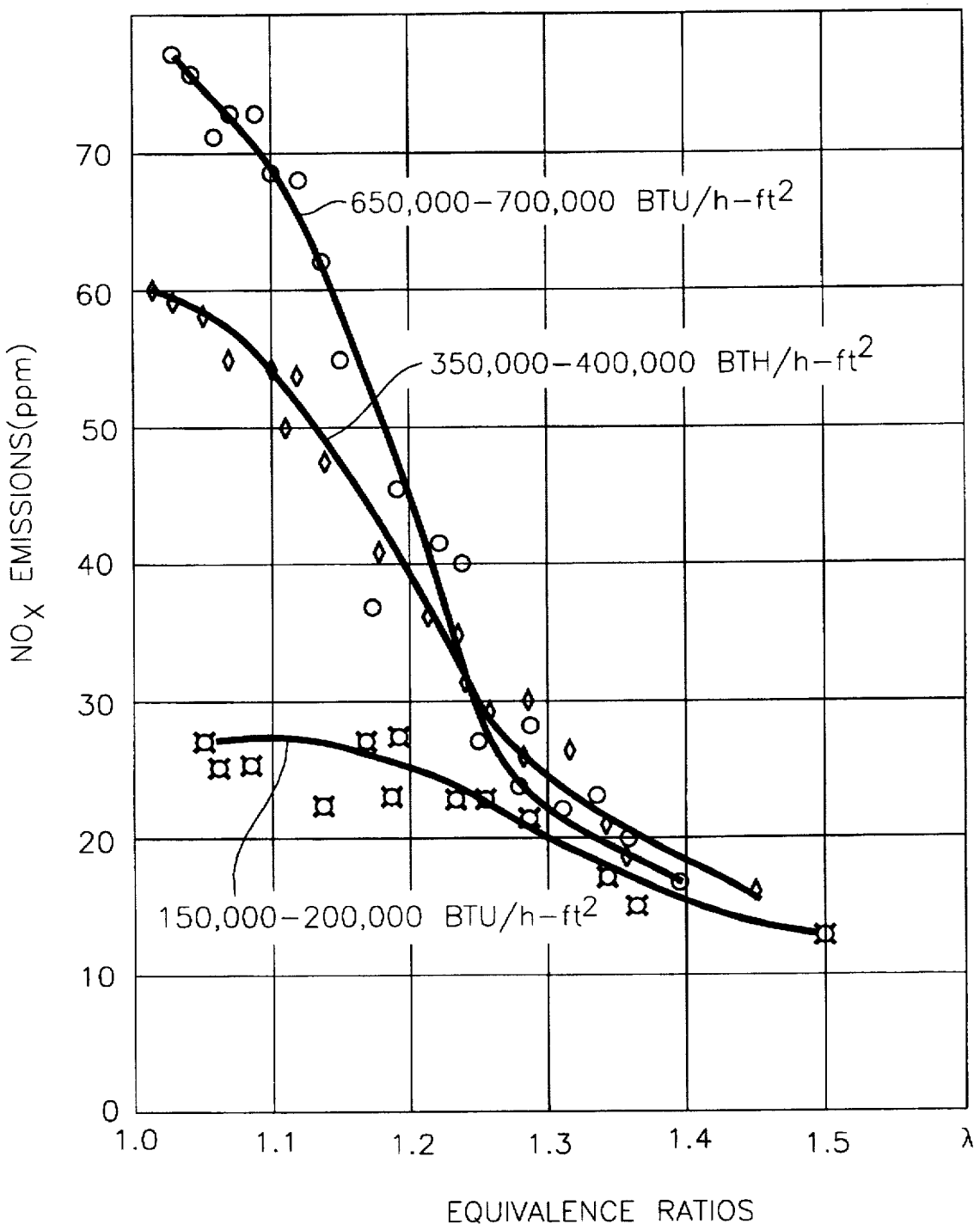

The same parameters of the invented burners are illustrated in FIG. 9. Analysis of the data which is presented in FIGS. 8 and 9 shows that a ceramic fiber burner can be used in all intervals of equivalence ratio only at fuel input at about 100,000 BTU/h·$ft^2$ (315 kW/$m^2$) or less. $NO_x$ emissions in this case do not exceed 30 ppm and meet a requirement of the SCAQMD. With a fuel input of 200,000 BTU/h·$ft^2$ (630 kW/$m^2$), $NO_x$ emissions from these burners meet the SCAQMD standard at an equivalence ratio ($\lambda$) greater than 1.3 and for 400,000 BTU/h·$ft^2$ (1.26 mW/$m^2$) only at $\lambda>1.45$.

Increasing the equivalence ratio decreases the efficiency of boilers and water heaters due to increasing heat losses. The invented burner generates less than 30 ppm $NO_x$ at a fuel input of about 160,000–200,000 BTU/h·$ft^2$ (500–630 kW/$m^2$) in all regions of equivalence ratio and at $\lambda>1.3$ $NO_x$ emissions meet the SCAQMD requirement for all tested fuel inputs up to 700,000 BTU/h·$ft^2$ (2.2 mW/$m^2$). It appears that the SCAQMD requirements may be met with fuel inputs as high as 3,000,000 BTU/h·$ft^2$ (9.4 mW/$m^2$). Tests of a burner at such a fuel input rate showed $NO_x$ output of about 60 ppm at this heating rate. The $NO_x$ output dropped below 30 ppm with flow rate between two and three million BTU/h·$ft^2$ at an equivalence ratio of 1.2. Therefore, use of the invention allows significantly increased thermal capacity of gas fired appliances, lower cost and reduced $NO_x$ emission simultaneously.

EXAMPLES AND TEST RESULTS

Four different types of small scale burners were made and tested during investigation. The objectives of the tests were:

1. To find out the relationship between $NO_x$, CO emission and the main combustion characteristics such as specific fuel input (SFI) and equivalence ration ($\lambda$).
2. To study the dependence of the burner face temperatures ($T_2$) and temperature underneath the first (distributive) layer ($T_1$) versus SFI, $\lambda$, type of material of the distributive layer, emitters, stabilizers, etc.;
3. To determine the back pressure of the burner as a function of SFI, $\lambda$, materials, burner design;
4. To make a search of appropriate materials for distributive layer, emitters, and stabilizers;
5. To learn major criteria for invented burner design (such as width of the gaps between layers, numbers of layers, materials of the layers and their thicknesses, diameters, shapes, etc.), which are optimized in terms of lowering $NO_x$ emissions, increasing turndown, efficiency of heat transfer, etc.

Figure 10:
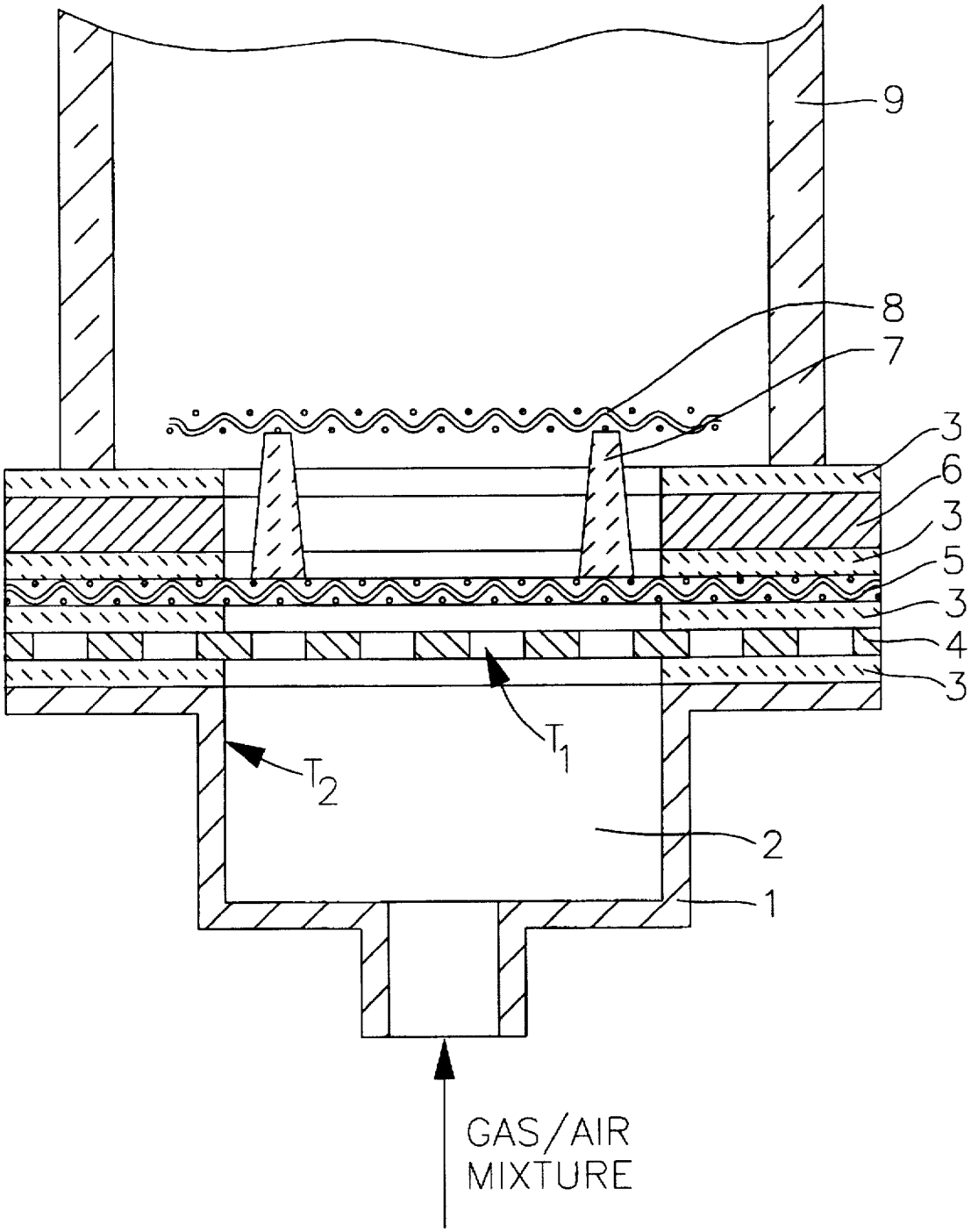
FIG. 10 illustrates in schematic cross-section an experimental burner.

FIG. 10 schematically illustrates a first design of high firing density laboratory burner. It comprises a burner tray 1, seal frames 3 made from alumina felt ⅛ inch thickness, a supportive layer of perforated metal 4, a porous distributive layer of twilled weave Kanthal wire 5, a steel frame (¼" thickness) 6, an emitter 8 made of Kanthal AF (screen approximately 3 inch×4 inch, wire=0.020 inch, 10 meshes per inch), based on four ceramic legs 7. A quartz tube 9 is installed on the top of the burner for separation of the ambient air from waste gases. The dimensions of the burner's open area are 2 inch×3.5 inch (5×9 cm). The gap between the first (distributive) layer 5 and emitter 8 is about 0.7 inch. The first (distributive) layer 5 is made of the stranded twilled weave like that available from Cleveland Wire Cloth & Manufacturing Co., Cleveland, Ohio.

A Kanthal AF screen has been used as an emitter 8. Kanthal AF is an iron-chromium-aluminum alloy available in the form of wires and other shapes from Kanthal Corporation, Bethel, Conn. Screens made of Kanthal wire are available from National Standard, Korbin, Ky. The nominal composition of Kanthal AF is 22% chromium, 5.3% aluminum and a balance of iron. Other suitable alloys include Kanthal APM and Kanthal A-1 which have similar composition except the aluminum content is 5.8%. These Kanthal alloys a continuous operating temperature of up to 1400° C. Other high temperature oxidation resistant alloys may also be used.

The flame front is located between the first (twilled weave) and second (Kanthal screen) layers. The twilled weave distributor layer has very little open area, no more than about 10%, that is, it appears nearly opaque because of the nature of the weave. The screen, on the other hand, has about 64% open area and 36% wires. The emitter 8 worked in bright red (radiant) mode during tests and dissipated considerable energy into the ambient area. Tests were all made with natural gas (essentially methane) and air.

The ranges of combustion variables are listed:

1. Specific fuel input—from 150,000 to 700,000 BTU/h·ft$^2$ (0.47 to 2.2 mW/m$^2$). Later this burner has been tested with SFI up to 2,000,000 BTU/h·ft$^2$) (6.3 mW/m$^2$;
2. Equivalence ratio—from 1.05 to 1.60.

The $NO_x$ formation at these conditions is presented in FIG. 9.

Comparison of the $NO_x$ emissions from the ceramic fiber burners (FIG. 8) and invented burners (FIG. 9) shows a great advantage of the new burners. The SCAQMD requirement is 30 ppm and the new burners meet this limit at $\lambda$~1.25 even with a maximum SFI of 700,000 BTU/h·ft$^2$ (2.2 mW/m$^2$). Ceramic fiber burners with an SFI of 200,000 BTU/h·ft$^2$ (0.63 mW/m$^2$) that is ~3 to 5 times less than the new burner meet the SCAQMD requirement at $\lambda \approx 1.3$. It means that the new burners are able to provide a significant reduction in $NO_x$ emissions or dramatically increase the heat capacity of boilers, water heaters and gas-fired appliances without increasing $NO_x$ emission.

Turndown has been reached at about 4.7:1, which is much better than conventional radiant burner turndown (usually less than 3:1). Later we reached a turndown ratio of 10:1 (without $NO_x$ measurement) from 100,000 BTU/h·ft$^2$ (315 kW/m$^2$) to 1,000,000 BTU/h·ft$^2$ (3.15 mW/m$^2$). This widens the top of the range limit for burner operation. Typically the highest SFI for conventional ceramic fiber burners is about 150,000 to 200,000 BTU/h·ft$^2$ (470 to 630 kW/m$^2$). After increasing the size of the gap between the distribution layer 5 and emitter layer 8 from ≈0.7 inch to ≈1.7–1.8 inch, we reached a maximum SFI greater than 2,200,000 BTU/h·ft$^2$ (6.9 mW/m$^2$). This test was done without measurement of $NO_x$ emissions.

The next improvement in the burner performance is a multilayer design, which is illustrated in FIG. 11. We call this model burner #1. We use the same burner tray 1, alumina fiber felt seal frames 3, steel frame 6 and quartz tube 9. Instead of stranded twilled weave, a woven ceramic fabric, Nextel 312, is used as a first (distributive) porous layer 5. Nextel 312 is a woven fabric of alumina-boria-silica fibers. A steel frame 18 made from wire ⅛ inch diameter wire with a perforated zirconia felt layer 19 is used as a second layer or first emitter. The material used is Type ZYF50 zirconia felt available from Zircar Products, Inc., Florida, N.Y. This material is a felt of zirconia fibers having a thickness of 0.05 inch and a porosity of 96% voids. To further increase the open area of zirconia felt it was punctured using perforated metal as a blank. The perforations are 3/16 inch diameter round holes staggered in rows on 5/16 inch centers, yielding approximately 33% openings through the felt.

The first emitter was made by placing the perforated zirconia felt 19 underneath the steel frame 18 and tying the zirconia felt to the frame by means of a single fiber of Nextel 312 ceramic. This design places more of the emitter's substances in a high temperature zone and dissipates more energy away from the flame for additional $NO_x$ reduction. A second change was to use a thicker structure in the flame zone and allow the burner to operate two downstream Kanthal screen emitters 20 within a temperature range less than 1100° C. The two Kanthal emissive layers are supported on ceramic blocks 21.

This burner was tested with SFI from 1,400,000 BTU/h·ft$^2$ to 1,500,000 BTU/h·ft$^2$ (4.4 to 4.7 mW/m$^2$) and equivalence ratio ranges from 1.03 to 1.65. The results of the tests are presented in FIGS. 14, 15 and 16 and in Table 2. In the table there are columns labeled with temperatures $T_1$ and $T_2$. These are temperatures at the points indicated in FIGS. 10 and 11. The temperature of the gas inlet plenum is actually higher than the temperature of the first porous layer. This is due to heat conduction through the structure to the plenum, whereas there is gas cooling of the porous distributive layer by gas flow and cooling due to expanding of the combustible mixture through the distributive layer.

Figure 14:
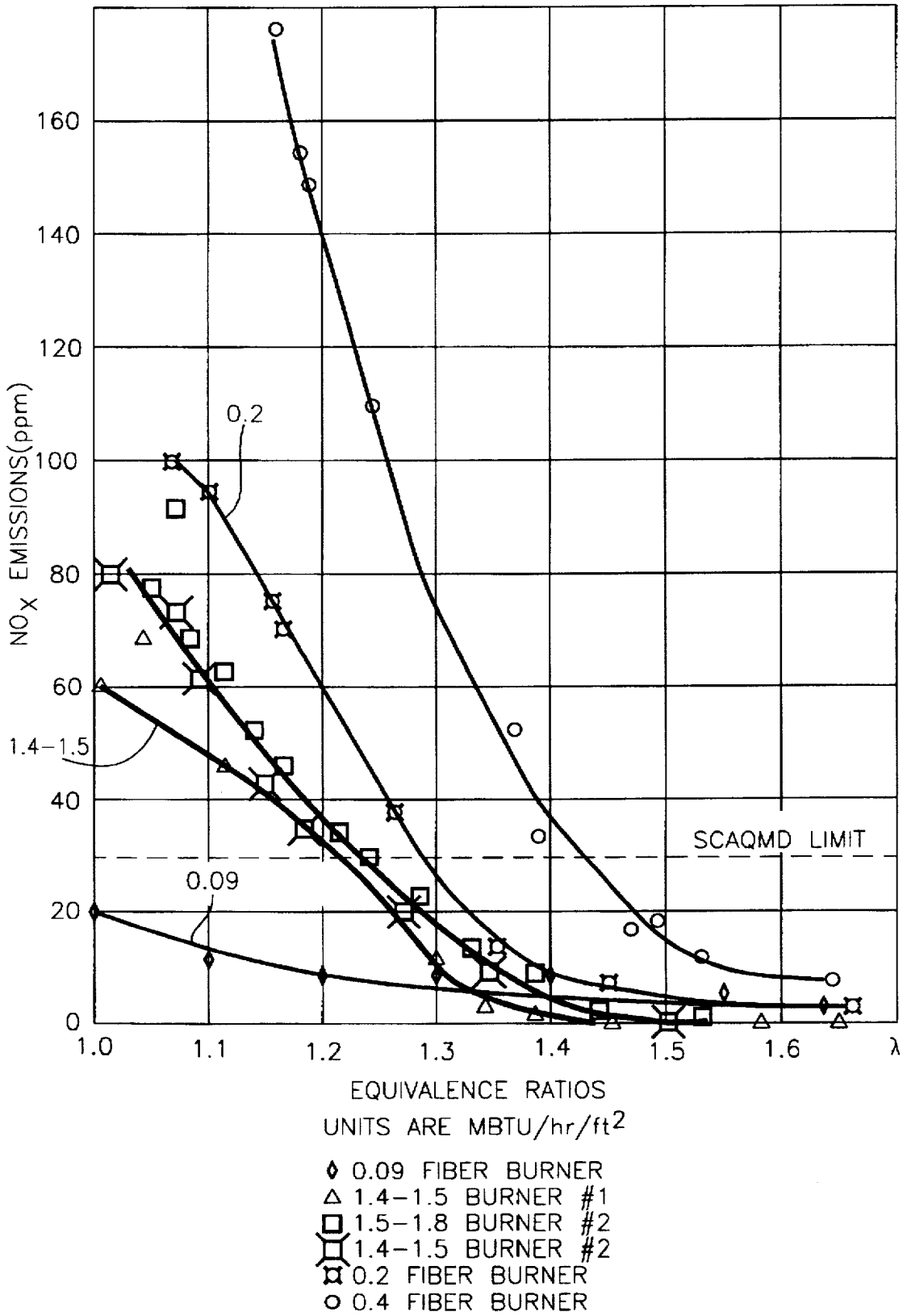
FIGS. 14 to 16 are each graphs are of $NO_x$ emissions as a function of heating rate and equivalence ratio for various burners.

FIG. 14 illustrates a significant advantage of this design versus a ceramic fiber burner. The new burner (burner #1) meets the SCAQMD requirement of 30 ppm $NO_x$ emissions at $\lambda \approx 1.2$ even at SFI of about 1,400,000–1,500,000 BTU/h·ft$^2$ (4.4 to 4.7 mW/m$^2$). At the same time, $NO_x$ emission from ceramic fiber burners are 60 ppm (2 times more) for only 200,000 BTU/h·ft$^2$ (630 kW/m$^2$) (i.e. with about 7.25 times less heat output) and about 140 ppm (6.3 mW/m$^2$) (4.7 times more) for 400,000 BTU/h·ft$^2$ (1.26 mW/m$^2$) (3.6 times less heat output). Units tabulated on the drawing are in millions of BTU per hour per square foot of burner area.

Figure 15:
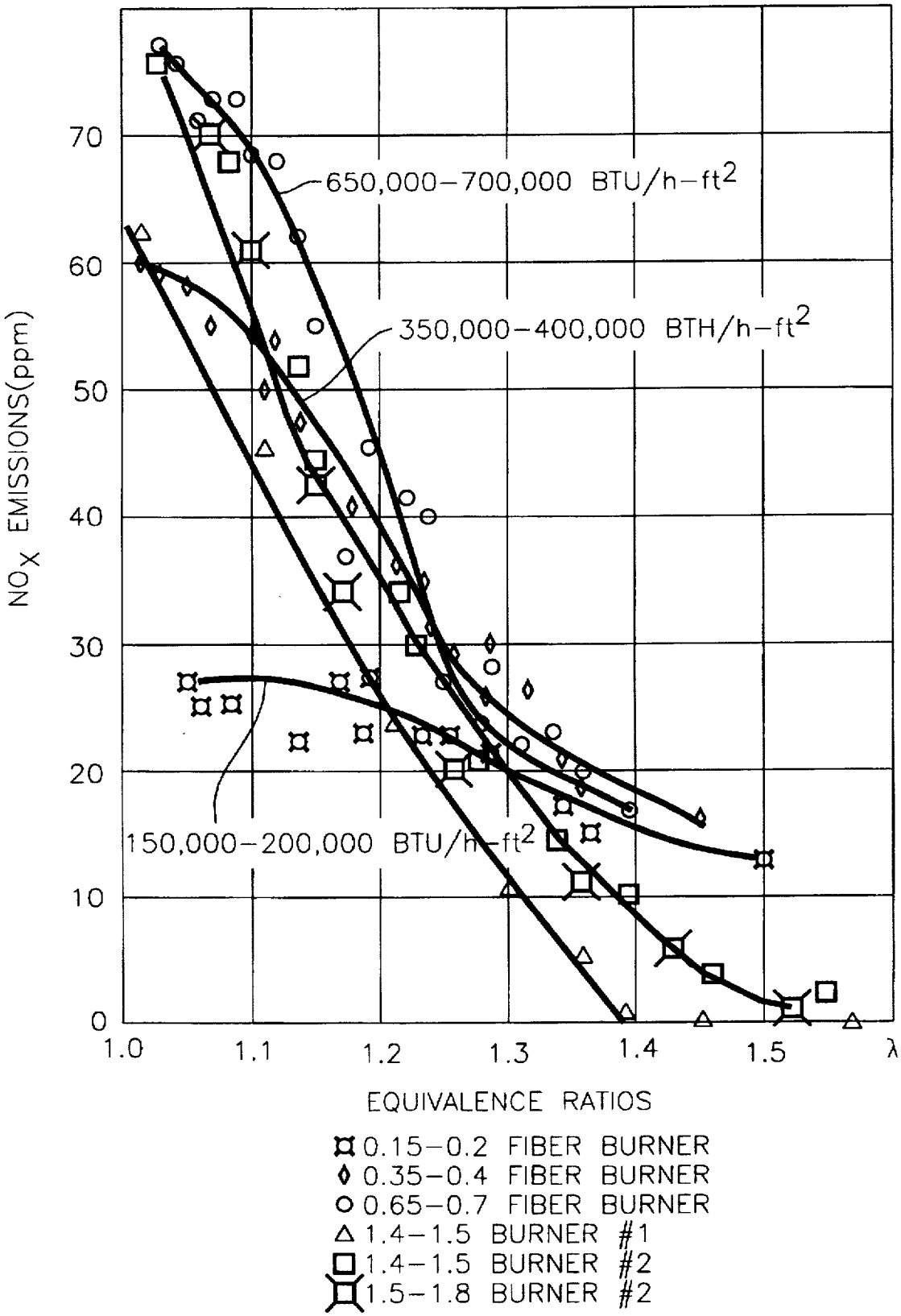
Figure 16:
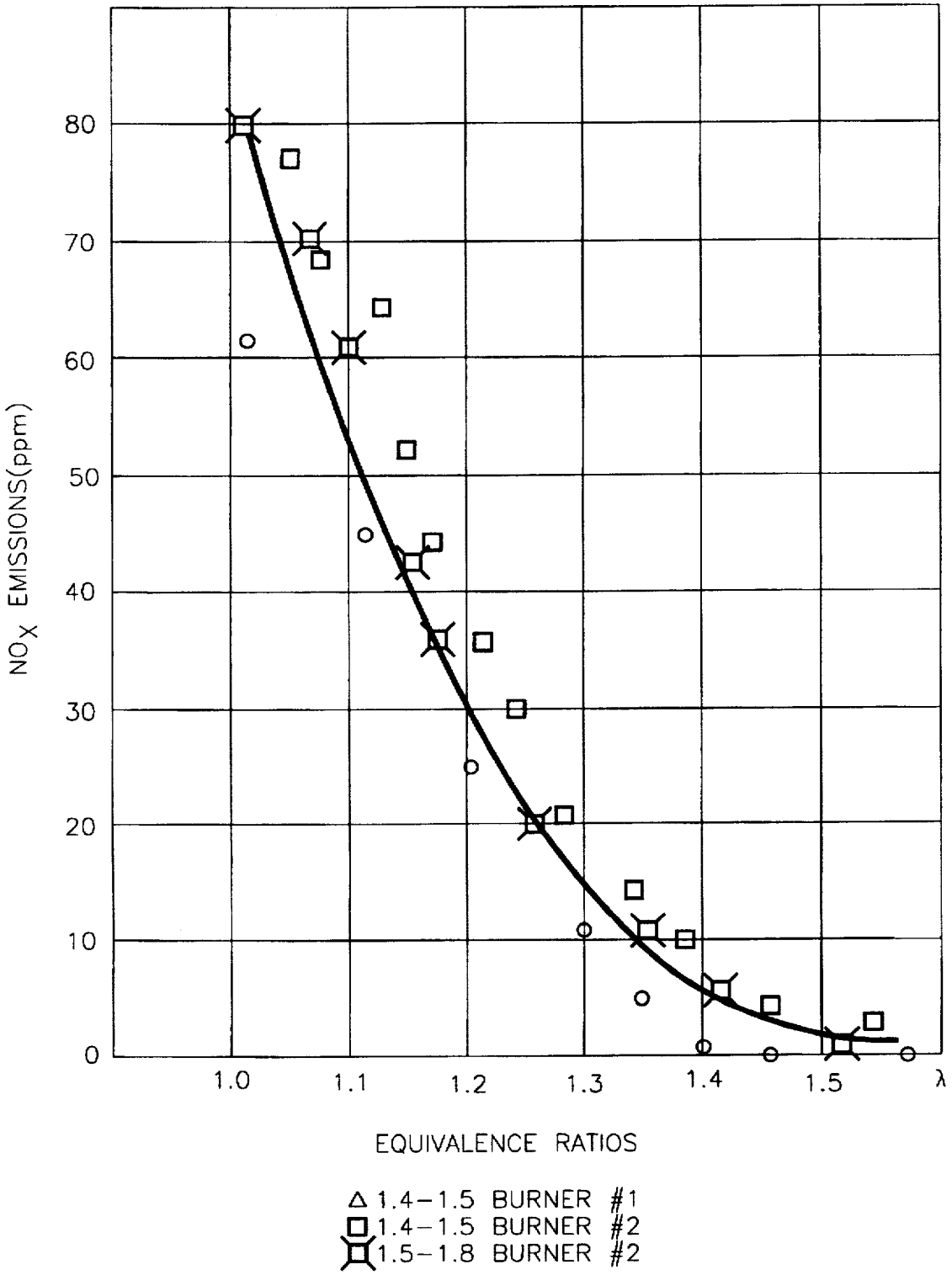

FIG. 15 shows the comparison of the $NO_x$ formation in flames of the burner #1 with the first high firing density design. The $NO_x$ emission less than 30 ppm is achieved approximately at the same $\lambda$ as the first high firing density burner but burner #1 has much higher SFI.

Figure 13:
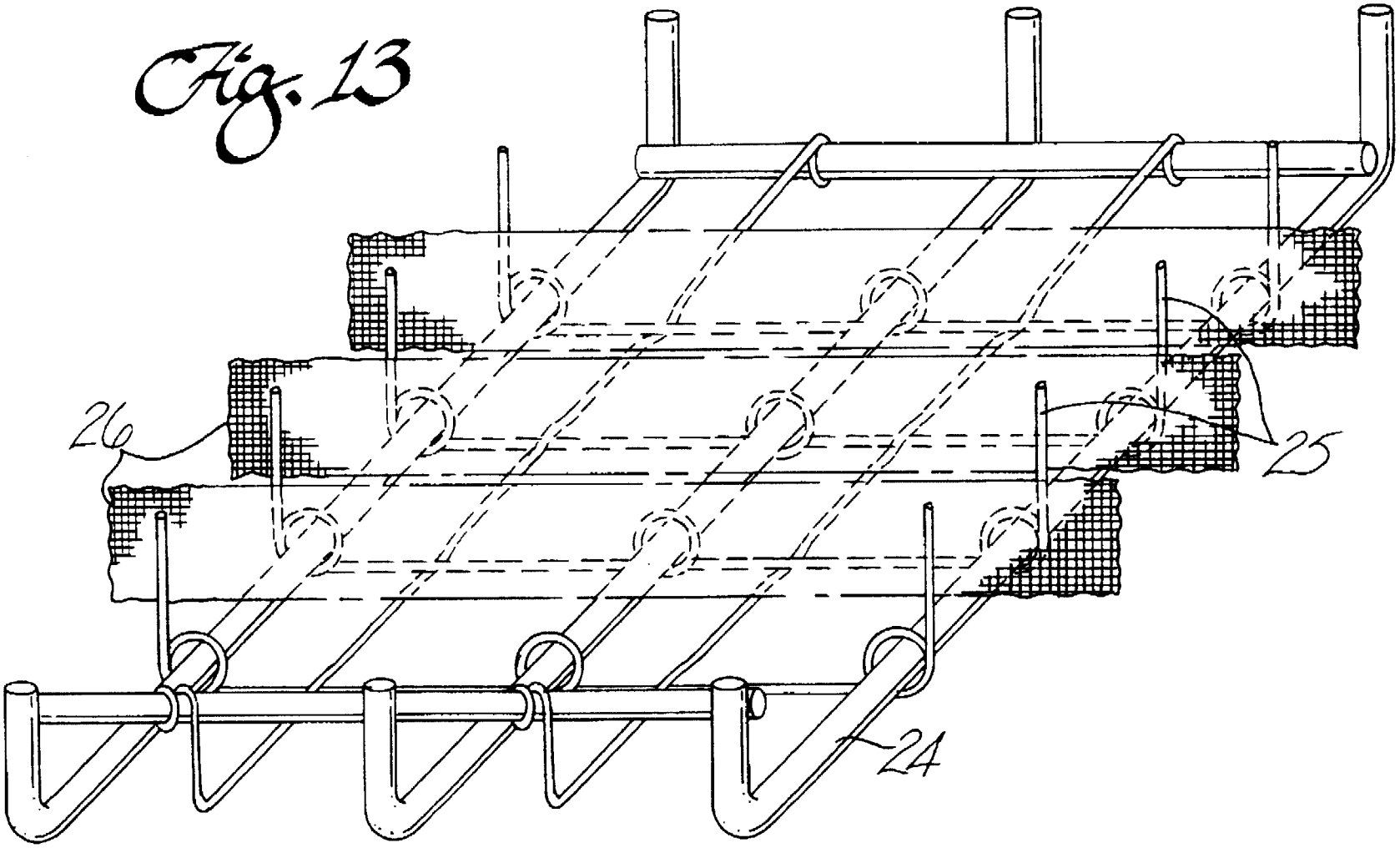
FIG. 13 illustrates isometrically a frame and screen arrangement employed in the burner of FIG. 12.

FIG. 12 demonstrates the same burner further comprising means for removing heat from the flame zone. We call it burner #2. It is based on the same burner tray 1, alumina fiber felt seal frames 3, woven fabric Nextel 312 as a distributive layer 6, steel frame 5, first emitter made of steel frame 21 and perforated zirconia felt 22 and two layers of Kanthal screen emitter layers 23. An additional emitter structure is inserted between the steel frame-zirconia felt emitter and the Kanthal screen emitters 23. The new emitter structure is made of a steel frame 24 with an additional 1.3 mm diameter Kanthal wire 25 and three pieces of Kanthal screen 26 parallel to the direction of gas flow as shown in FIG. 13. The top of the frame is covered by a piece of Kanthal screen 28 (the same material as emitters 23).

This burner was tested with SFI of about 1,400,000–1,500,000 BTU/h·ft$^2$ and 1,600,000–1,800,000 BTU/h·ft$^2$ (4.4–4.7 to 5.05–5.67 mW/m$^2$). The test results are presented in FIGS. 14, 15 and 16, and in Table 2. $NO_x$ emissions from this burner are close to those obtained by burner #1 and show that it is possible to optimize the size of each emitter and distance between emissive layers in terms of $NO_x$ emission, the maximum temperature of the emitter, back pressure, and SFI.

TABLE 2

TEST RESULTS FOR BURNERS #1 AND #2

| Run No. | SFI, $10^6$ BTU/h·ft$^2$ | Back pressure, inch W.C. | $T^{MAX}$ Emitter °C. | $T_1$ °C. | $T_2$ °C. | Equivalence ratio λ | CO ppm | NOx ppm correct to $O_2$ = 3% |
|---|---|---|---|---|---|---|---|---|
| | | | Burner #1 (1.4–1.5) · $10^6$ BTU/h·ft$^2$ | | | | | |
| 1 | 1.419 | 3.85 | 1342 | 90 | 143 | 1.03 | 2 | 62 |
| 2 | 1.396 | 4.3 | 1320 | 84 | 130 | 1.11 | 0 | 45 |
| 3 | 1.433 | 4.9 | 1293 | 75 | 112 | 1.21 | 0 | 24 |
| 4 | 1.441 | | | | | 1.30 | 0 | 11 |
| 5 | 1.427 | 5.8 | 1226 | 61 | 80 | 1.36 | 0 | 5 |
| 6 | 1.471 | 6.0 | 1201 | 50 | 72 | 1.39 | 0 | 1 |
| 7 | 1.437 | 6.5 | 1175 | 47 | 82 | 1.46 | 0 | 0 |
| 8 | 1.525 | 7.6 | 1127 | 43 | 68 | 1.57 | 0 | 0 |
| 9 | 1.514 | 8.3 | 1080 | 39 | 50 | 1.65 | 0 | 0 |
| 10 | | | Burner #2 (1.4–1.5) · $10^6$ BTU/h·ft$^2$ | | | | | |
| 11 | 1.459 | 4.4 | 1276 | 101 | 161 | 1.01 | 0 | 80 |
| 12 | 1.450 | 4.6 | 1256 | 96 | 151 | 1.07 | 0 | 70 |
| 13 | 1.432 | 4.95 | 1246 | 91 | 143 | 1.10 | 0 | 61 |
| 14 | 1.418 | 5.5 | 1223 | 84 | 133 | 1.16 | 0 | 43 |
| 15 | 1.444 | 5.85 | 1204 | 76 | 120 | 1.18 | 0 | 35 |
| 16 | 1.454 | 6.3 | 1171 | 70 | 109 | 1.27 | 0 | 20 |
| 17 | 1.406 | 6.5 | 1141 | 59 | 97 | 1.36 | 0 | 11 |
| 18 | 1.421 | 6.8 | 1121 | 52 | 79 | 1.42 | 0 | 6 |
| 19 | 1.379 | 6.6 | 1070 | 47 | 68 | 1.51 | 0 | 1 |
| 20 | 1.577 | 8.5 | 1070 | 47 | 68 | 1.51 | 0 | 1 |
| 21 | | | Burner #2 (1.6–1.8) · $10^6$ BTU/h·ft$^2$ | | | | | |
| 22 | 1.614 | 5.3 | 1293 | 96 | 153 | 1.05 | 0 | 77 |
| 23 | 1.633 | 5.6 | 1281 | 93 | 151 | 1.08 | 0 | 68 |
| 24 | 1.613 | 6.0 | 1256 | 85 | 136 | 1.14 | 0 | 52 |
| 25 | 1.614 | 6.3 | 1259 | 85 | 142 | 1.17 | 0 | 44 |
| 26 | 1.582 | 6.3 | 1243 | 76 | 118 | 1.21 | 0 | 35 |
| 27 | 1.582 | 6.2 | 1221 | 70 | 103 | 1.24 | 0 | 30 |
| 28 | 1.679 | 7.5 | 1200 | 76 | 123 | 1.28 | 0 | 21 |
| 29 | 1.689 | 8.0 | 1184 | 70 | 113 | 1.34 | 0 | 14 |
| 30 | 1.708 | 8.6 | 1154 | 64 | 100 | 1.39 | 0 | 10 |
| 31 | 1.762 | 9.4 | 1124 | 53 | 85 | 1.46 | 0 | 4 |
| 32 | 1.775 | 10.3 | 1098 | 50 | 77 | 1.53 | 0 | 3 |

Figure 17:
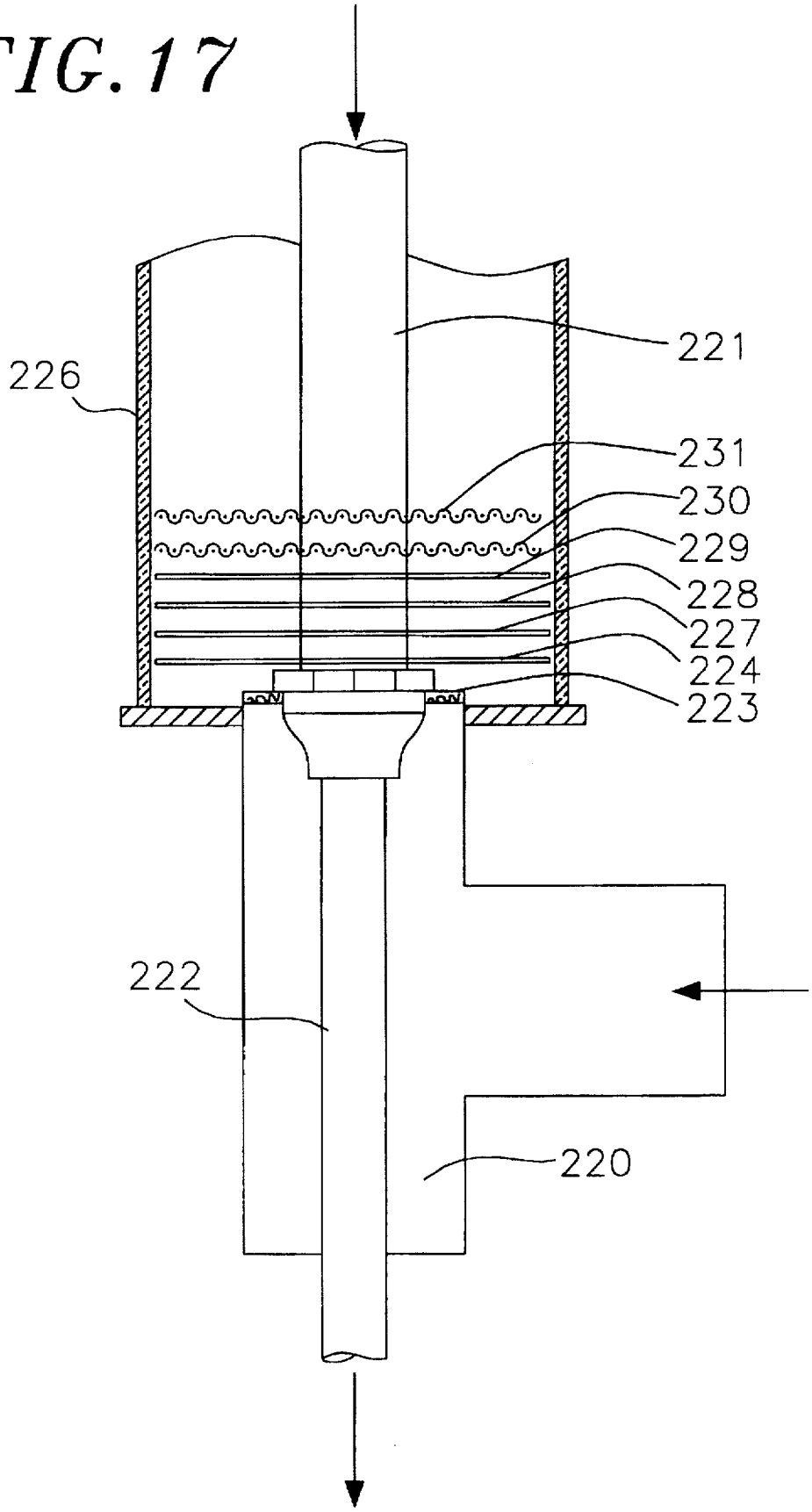
FIG. 17 is a schematic longitudinal cross section of another experimental burner which has sustained a heating rate of 3,000,000 BTU/h·ft$^2$.

FIG. 17 illustrates another embodiment of experimental burner with relatively thick emitting layers. The burner is assembled on a large pipe tee 220. A combustible fuel-air mixture is introduced through the branch of the tee. A one-half inch NPT steel pipe heat exchanger 221 extends vertically through the hot zone above the burner. The heat exchanger is necked down to half-inch copper tubing 222 which extends through the run of the tee.

At the upper end of the run of the tee, there is a distributive layer 223 of Nextel 312 fabric as hereinabove described. Above the distributive layer are six emitter layers. The first emitter layer is spaced about one centimeter above the Nextel. The individual emitter layers are spaced apart from each other about one centimeter.

The first emitter layer 224 comprises a six millimeter diameter metal rod wrapped into a spiral which fits closely around the heat exchanger and near the glass shroud 226 surrounding the hot zone. The outside diameter of the spiral is about 14 centimeters. The spacing between the turns in the spiral is about one centimeter. The second emitting layer 227 is somewhat similar to the first. It comprises a spiral of three millimeter diameter refractory metal wound into a flat spiral. The size and spacing are about the same as the first emitter layer.

The next emitter layer 228 comprises a refractory metal plate approximately two millimeters thick perforated with 2.5 millimeter diameter holes so as to have an open area of about 40 to 50 percent. The fourth emitting layer 229 comprises concentric rings of two millimeter diameter wire with the outermost ring being about 14 centimeters diameter and the innermost ring fitting closely around the heat exchange pipe 221. Radially extending wires support the concentric rings.

The final two emitters 230 and 231 each comprise metal screen wire as hereinabove described. The wires are about 0.5 millimeter diameter, and there about four openings per centimeter in each direction.

Such a burner showed a corrected $NO_x$ output of less than 30 ppm at an equivalence ratio of only about 1.1 when operated with a fuel input of 1,500,000.00 BTU/h·ft$^2$. The $NO_x$ output was only about 40 ppm at an equivalence ratio of 1.05.

A significant advantage of such burners is the opportunity to design a low cost, highly reliable radiant burner with extremely high SFI and ultra low $NO_x$ emissions.

Although a number of embodiments of gas fired appliances have been described and illustrated herein, it will be apparent that many further modifications and variations can be made. The spacings between layers and porosities of the layers can be varied over wide ranges. The materials of construction are exemplary and other high temperature materials may clearly be substituted. Thus, within the scope of the following claims, the invention may be practiced otherwise than as specifically described.

What is claimed is:

1. A matrix burner comprising:

a three dimensional porous gas distributing layer for distributing a fuel/air mixture;

a three dimensional matrix of emissive layers comprising at least three two dimensional porous layers downstream from the distributing layer;

open spaces between each of the successive layers; and means for delivering a fuel/air mixture to the upstream face of the porous distributing layer at a sufficient velocity for maintaining a stable flame adjacent to the two dimensional porous layers.

2. A matrix burner as recited in claim 1 wherein the outermost porous layer has an open area smaller than the open area of a preceding layer.

3. A matrix burner comprising:

a porous gas distributing layer for distributing a fuel/air mixture;

first two dimensional porous layer downstream from the distributing layer;

a second two dimensional porous layer downstream from the first layer, the second porous layer having sufficient open area for transmitting radiation from the first layer;

an open space between the first and second layers;

a third porous layer in the space between the first and second two dimensional porous layers, the third layer having a open area greater then the open area of the second layer; and means for delivering a fuel/air mixture to the upstream face of the porous distributing layer at a sufficient velocity for maintaining a flame front approximately at the first porous layer.

4. A matrix burner comprising:

a first porous material layer;

means for delivering a fuel/air mixture to one face of the porous material layer;

a second two dimensional porous material layer having a larger porosity that the porosity of the first layer;

a third two dimensional porous material layer downstream from the second layer, the second and third layers serving as structures for emitting radiant heat, a fourth porous layer downstream from the third porous layer and spaced apart from the second layer, and, an open combustion zone space between the first and second layers.

5. A matrix burner comprising:

a first porous material layer;

a second porous material layer, downstream of and spaced apart from the first layer;

a third porous material layer, downstream of and spaced apart from the second layer, the second and third layers serving as structures for emitting radiant heat;

a fourth porous layer in the space between the third and second layers and spaced apart from each of the third and second layers;

an open combustion zone space between the first and second layers; and, means for delivering a fuel/air mixture to one face of the first porous material layer at a sufficient velocity for maintaining a flame front in the open combustion zone space.

6. A matrix burner as recited in claim 5 wherein the third porous layer in the space between the first and second layers has a porosity no greater than the porosity of the second layer.

7. A matrix burner comprising:

a first porous material layer;

a second porous material layer;

an open combustion zone space between the first and second layers;

a flashback protective heat exchanger for removing heat from the first porous layer; and, means for delivering a fuel/air mixture to one face of the first porous material layer at a sufficient velocity for maintaining a flame front in the open combustion zone space.

8. A matrix burner comprising:

a first porous material layer;

a second porous material layer;

an open combustion zone space between the first and second layers;

a flashback protective heat exchanger integrated into the first porous layer for removing heat from the porous layer; and, means for delivering a fuel/air mixture to one face of the first porous material layer at a sufficient velocity for maintaining a flame front in the open combustion zone space.

9. A matrix burner comprising:

a first porous material layer;

a second porous material layer;

an open combustion zone space between the first and second layers;

a superemitting substance on at least a surface of the second porous layer; and, means for delivering a fuel/air mixture to one face of the first porous material layer at a sufficient velocity for maintaining a flame front in the open combustion zone space.

10. A matrix burner as recited in claim 8 further comprising a surface for absorbing photons characteristic of the photons emitted by the superemitting substance.

11. A matrix burner as recited in claim 9 wherein the surface for absorbing photons comprises a photovoltaic cell for absorbing photons characteristic of the photons emitted by the superemitting substance.

12. A matrix burner as recited in claim 10 further comprising a transparent member between the burner and the photovoltaic cell for transmitting photons therebetween and avoiding direct convective heat transfer therebetween.

13. A matrix burner as recited in claim 11 further comprising a heat exchanger downstream from the burner and transparent member for recovering heat from exhaust gas from the burner.

14. A matrix burner comprising:

a first porous material layer;

a second porous material layer;

an open combustion zone space between the first and second layers;

additional layers of porous material between the first and second layers for enhancing combustion stability and lowering NOx emission; and, means for delivering a fuel/air mixture to one face of the first porous material layer at a sufficient velocity for maintaining a flame front at a sufficient velocity for maintaining a flame front in the open combustion zone space.

15. A matrix burner comprising:

a first porous material layer;

a second porous material layer, wherein the second porous material layer comprises a superemissive material including a rare earth metal oxide for emitting narrow band emissions;

an open combustion zone space between the first and second layers; and, means for delivering a fuel/air mixture to one face of the first porous material layer at a sufficient velocity for maintaining a flame front in the open combustion zone space.

* * * * *

UNITED STATES PATENT AND TRADEMARK OFFICE

CERTIFICATE OF CORRECTION

PATENT NO. : 5,711,661
DATED : January 27, 1998
INVENTOR(S) : Aleksandr S. Kushch; Mark K. Goldstein It is certified that error appears in the above-indentified patent and that said Letters Patent is hereby corrected as shown below:

Column 18, line 26, change "claim 8" to -- claim 9 --.
Column 18, line 29, change "claim 9" to -- claim 10 --.
Column 18, line 33, change "claim 10" to -- claim 11 --.
Column 18, line 37, change "claim 11" to claim 12 --.

Signed and Sealed this

Twenty-fourth Day of November, 1998

*Attest:*

Bruce Lehman

BRUCE LEHMAN

*Attesting Officer*

*Commissioner of Patents and Trademarks*